US010626647B2

(12) United States Patent
Hegner et al.

(10) Patent No.: US 10,626,647 B2
(45) Date of Patent: Apr. 21, 2020

(54) UNIVERSAL SLIDING DOOR SYSTEM

(71) Applicant: Chase Industries, Inc., Cincinnati, OH (US)

(72) Inventors: Michael L. Hegner, Cincinnati, OH (US); Robert J. Clark, Cincinnati, OH (US); Julian M. Cornwall, Cincinnati, OH (US); Michael S. Conley, Maineville, OH (US)

(73) Assignee: Chase Industries, Inc., Cincinnati, OH (US)

( * ) Notice: Subject to any disclaimer, the term of this patent is extended or adjusted under 35 U.S.C. 154(b) by 74 days.

(21) Appl. No.: 15/716,725

(22) Filed: Sep. 27, 2017

(65) Prior Publication Data

US 2018/0087302 A1 Mar. 29, 2018

Related U.S. Application Data

(60) Provisional application No. 62/400,822, filed on Sep. 28, 2016.

(51) Int. Cl.

| | |
|---|---|
| ***E05D 15/06*** | (2006.01) |
| ***E06B 3/46*** | (2006.01) |
| ***E06B 1/52*** | (2006.01) |

(52) U.S. Cl.

CPC ..... *E05D 15/0608* (2013.01); *E05D 15/0621* (2013.01); *E06B 1/526* (2013.01);
(Continued)

(58) Field of Classification Search

CPC ..... E06B 15/0608; E06B 1/526
(Continued)

(56) References Cited

U.S. PATENT DOCUMENTS 1,288,575 A * 12/1918 Harris ..... B61D 19/005 49/426
1,379,565 A * 5/1921 Hickok ..... E05D 15/066 16/100

(Continued)

FOREIGN PATENT DOCUMENTS

CA 2394849 A * 7/2002 ..... E06B 1/04
CA 2634407 C 8/2013

(Continued)

OTHER PUBLICATIONS

Imperial Brown Inc., "Single Horizontal Sliding Cold Storage Doors," downloaded 2016 from http://imperialmfg.com/products/cold-storage-doors/imperial-walk-in-coolers-horizontal-sliding-cold-storage-doors/imperial-walk-in-coolers-single-horizontal-sliding-cold-storage-doors, 3 pgs.

(Continued)

*Primary Examiner* — Marcus Menezes
(74) *Attorney, Agent, or Firm* — Frost Brown Todd LLC

(57) ABSTRACT

A universal sliding door system that is configured to facilitate installation in either a slide right to open (SRO) orientation or a slide left to open (SLO) orientation. In some embodiments, a track is attached to a header by a pivot connector that allows the track to be pivoted up or down so that the track can be easily oriented at an appropriate angle for the desired opening orientation. The header and track may also each include a first set of openings configured to allow the track to be easily installed in a SRO orientation and a second set of openings configured to allow the track to be easily installed in a SLO orientation. Other components of the door system, such as the door and the vertical casing members may also include features configured to allow the components to easily be installed in either opening orientation.

14 Claims, 24 Drawing Sheets

(52) U.S. Cl.
CPC ..... *E06B 3/4636* (2013.01); *E05Y 2800/17* (2013.01); *E05Y 2800/174* (2013.01); *E05Y 2800/72* (2013.01)

(58) Field of Classification Search
USPC ..... 49/452, 453, 425, 426, 409
See application file for complete search history.

(56) References Cited

U.S. PATENT DOCUMENTS

| | | | | | |
|---|---|---|---|---|---|
| 1,427,901 | A * | 9/1922 | Jager | B61D 19/005 | 49/426 |
| 1,521,816 | A * | 1/1925 | Jager | B61D 19/005 | 49/425 |
| 2,095,477 | A * | 10/1937 | Radford | E06B 3/44 | 49/425 |
| 2,767,423 | A * | 10/1956 | Gang | A47K 3/34 | 16/94 R |
| 3,074,124 | A * | 1/1963 | Bergstedt | E05D 15/063 | 49/231 |
| 3,097,401 | A | 7/1963 | Riegelman | | |
| 3,136,396 | A | 6/1964 | Sullivan | | |
| 3,281,993 | A | 11/1966 | Riegelman | | |
| 3,295,587 | A | 1/1967 | Horgan, Jr. | | |
| 3,348,337 | A * | 10/1967 | Grasso | B61D 19/005 | 49/449 |
| 3,370,383 | A | 2/1968 | Riegelman | | |
| 3,407,553 | A * | 10/1968 | Halpern | B66B 13/306 | 52/217 |
| 3,425,162 | A * | 2/1969 | Halpern | E05D 15/0634 | 49/425 |
| 3,431,690 | A * | 3/1969 | Halpern | E06B 1/70 | 49/425 |
| 3,436,864 | A * | 4/1969 | Halpern | E05D 15/066 | 49/425 |
| 3,805,450 | A * | 4/1974 | Forcina | E05D 15/08 | 49/231 |
| 3,879,894 | A | 4/1975 | Anderson | | |
| 5,461,829 | A | 10/1995 | Lehto et al. | | |
| 6,052,867 | A | 4/2000 | Haab et al. | | |
| 7,494,101 | B2 * | 2/2009 | Chen | A47B 88/43 | 211/192 |
| 8,056,286 | B2 * | 11/2011 | Gosling | E05D 15/063 | 49/404 |
| 8,336,265 | B2 | 12/2012 | Vosburg | | |
| 8,621,784 | B2 | 1/2014 | Gosling et al. | | |
| 8,653,982 | B2 * | 2/2014 | Yulkowski | G08B 21/043 | 340/686.1 |
| 8,904,712 | B2 | 12/2014 | Gosling et al. | | |
| 9,038,316 | B2 * | 5/2015 | Von Gerichten | E05D 15/063 | 49/360 |
| 2010/0281779 | A1 | 11/2010 | Vosburg | | |

FOREIGN PATENT DOCUMENTS

| | | | | |
|---|---|---|---|---|
| GB | 981263 | A * | 1/1965 | E05D 15/0621 |
| GB | 1444382 | A * | 7/1976 | E05D 15/06 |
| WO | WO 2016/108764 | A1 | 7/2016 | |

OTHER PUBLICATIONS

Jeld Wen, Windows & Doors, Sliding Patio Doors, The Summit Vinyl Collection, Patio Door Reversal, downloaded 2016 from http://www.jeld-wen.com/images/stories/pdf/installation_instructions/sds002.pdf, 3 pgs.

* cited by examiner

UNIVERSAL SLIDING DOOR SYSTEM

PRIORITY

This application claims the benefit of U.S. provisional patent application 62/400,822, filed Sep. 28, 2016, the disclosure of which is hereby incorporated by reference in its entirety.

BACKGROUND

Many traditional single sliding doors are designed and manufactured to be opened in a particular slide direction. For example, a single sliding door installation package, when ordered, might specify that it is slide right to open, or slide left to open. Specifying the direction of the slide may result in door features, such as tracks, handles, latches, or locks being manufactured or installed in such a way that they are not easily removable or reversible. With many conventional sliding doors, if a customer orders the wrong slide direction many components of the system may need to be modified, such as by disassembling them and drilling additional holes to allow for reversible reassembly, or replaced where disassembly or modification is not possible. This may introduce additional time and cost to installing the door system, and also may introduce additional risk of human error (e.g. drilling assembly holes in the wrong area of a track, header, casing or door) which may result in a damaged or unusable door system.

While a variety of sliding door systems have been made and used, it is believed that no one prior to the inventors has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements and in which.

Figure 1:
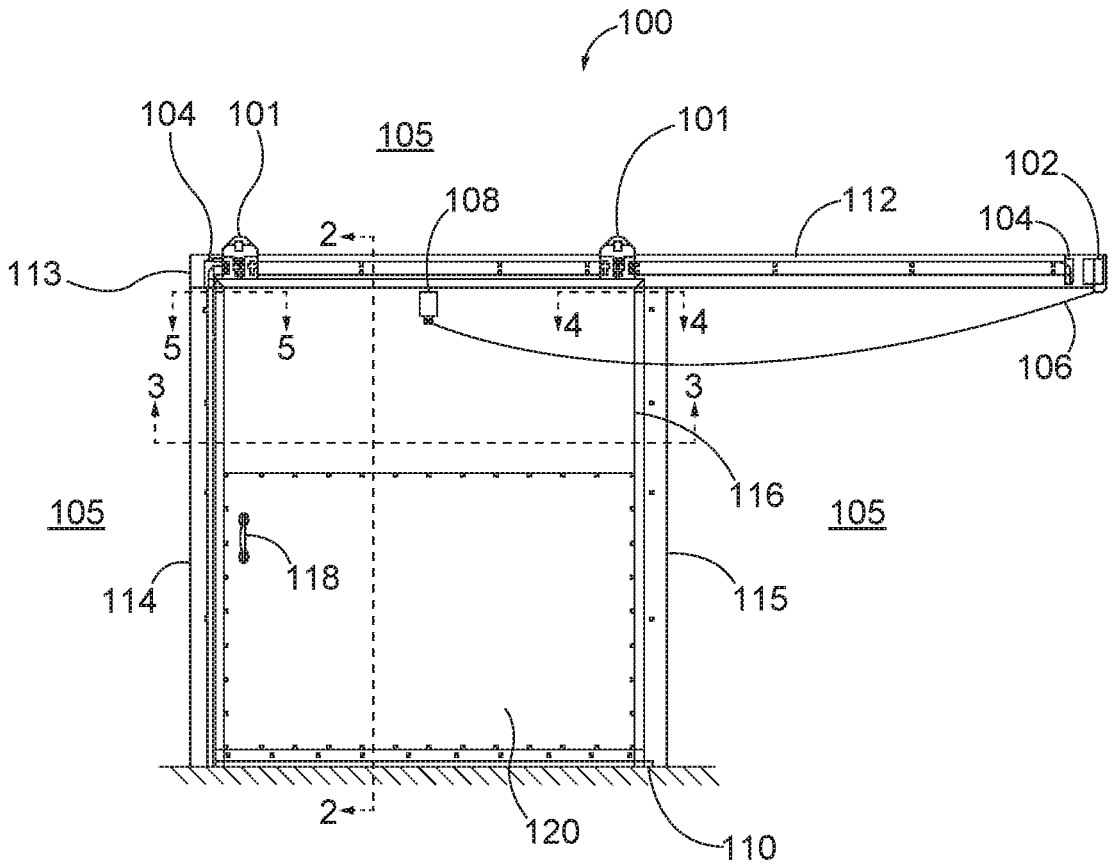
FIG. 1 depicts a front elevation view of an exemplary embodiment of a universal sliding door system configured and installed in a SRO orientation.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It will be appreciated that, for convenience and clarity, spatial terms such as "right" and "left" are used herein to describe components of embodiments of a universal sliding door system with reference to a person facing the front side door.

Embodiments of a universal sliding door system disclosed herein may be installed in a slide-right-to-open ("SRO") orientation or a slide-left-to-open ("SLO") orientation. When a door system is installed in a SRO orientation, the sliding door is positioned in front of the doorway or opening at the left end of the track when the door is in a closed position and travels laterally to the right along the track toward an open position. In this orientation, the door is positioned at the right end of the track when it is in a fully open position. Alternatively, when a door system is installed in a SLO orientation, the sliding door is positioned in front of the doorway or opening at the right end of the track when the door is in a closed position and travels laterally to the left along the track toward an open position. In this orientation, the door is positioned at the left end of the track when it is in a fully open position. If a person is facing the front side or surface of the door, the track will be visible, while if a person is facing the rear side or surface of the door, the track will be fully or mostly obstructed from view.

As used herein, the closing edge of the door refers to the edge of the door that leads when the door is sliding towards the closed position. Alternatively, the opening edge of the door refers to the edge of the door that leads when the door is sliding towards the open position. For example, when a door system is installed in a SRO orientation, the right side of the door is the opening edge and the left side of the door is the closing edge. Alternatively, when a door system is installed in a SLO orientation, the left side of the door is the opening edge and the right side of the door is the closing edge. Similarly, as used herein, the opening edge vertical casing member refers to the vertical casing member installed adjacent to the opening edge of the door when the door is in the closed position, while the closing edge vertical casing member refers to the vertical casing member installed adjacent to the closing edge of the door when the door is in the closed position. In addition, as used herein, the opening end of the header refers to the end of the header above and adjacent to the opening edge of the door when the door is in the open position, while the closing end of the header refers to the end of the header above and adjacent to the closing edge of the door when the door is in the closed position. Similarly, as used herein, the opening end of the track refers to the end of the track above and adjacent to the opening edge of the door when the door is in the open position, while the closing end of the track refers to the end of the track above and adjacent to the closing edge of the door when the door is in the closed position.

Figure 2:
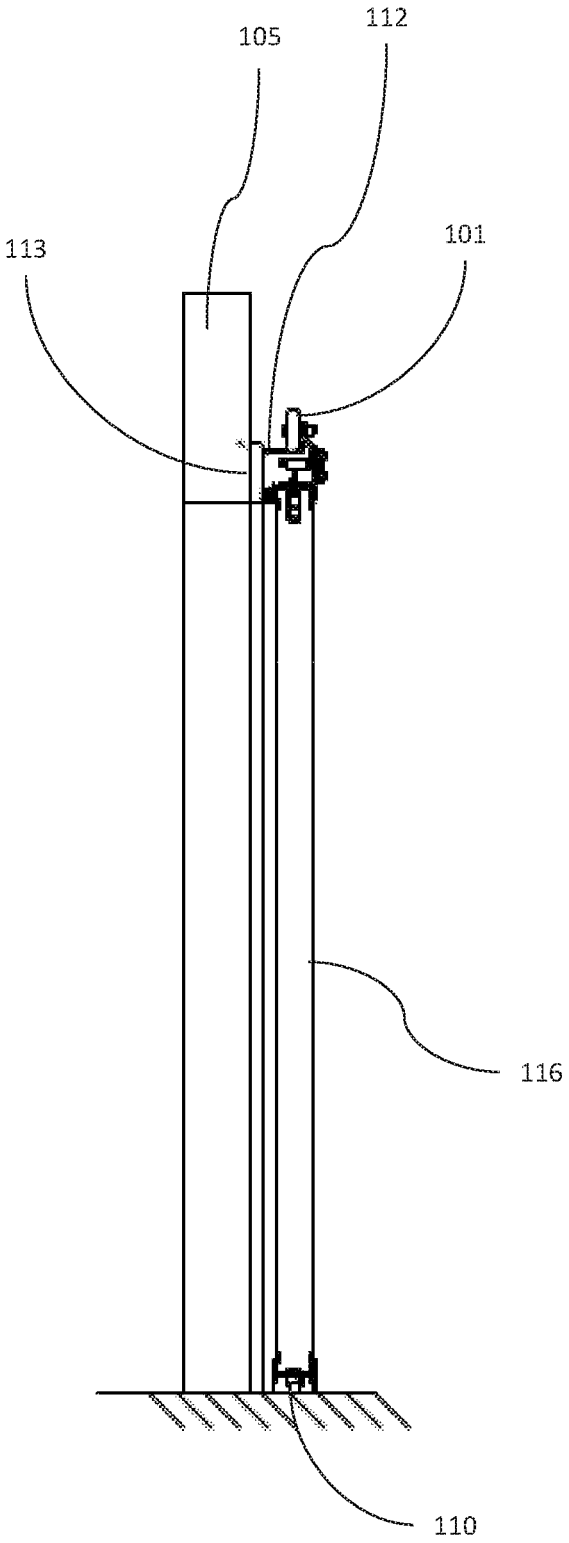
FIG. 2 depicts a side cross-sectional view of the system of FIG. 1 taken along the line 2-2.

Turning now to the figures, FIGS. 1-5 show an embodiment of a universal sliding door system (100) configured and installed in a SRO orientation. As shown, door system (100) includes a header (113), a track (112) attached to the header (113) and a door (116) suspended from the track (112). The door (116) may be a cooler door, a freezer door, or any other type of sliding door configured to be used as part of a universal sliding door system. In other embodiments, the door (116) may be a freezer door. The header (113) may be attached to a portion of a support structure, such as a wall (105), above the doorway (129). The door (116) may be suspended from the track (112) by one or more rollers (101) which allow the door (116) to hang and travel along the track (112) between an open position and a closed position. As shown in FIG. 2, rollers (101) may rest upon the track (112), and more specifically, may be positioned within a depression formed in the track (112). Preferably, the track (112) is angled relative to the header (113) so that the track (112) slopes downward from its opening edge to its closing edge. In other words, the closing edge of the track (112) may be lower than the opening edge of the track (112) which provides a slight grade so that rollers (101) will travel along the grade under the force of gravity and facilitate the transition of the door (116) from the open position into the closed position. For example, in the illustrated embodiment which is installed in a SRO orientation, the track (112) may be about one-half inch lower on the closing edge (i.e., the left edge) of the track (112) compared to the opening edge (i.e., the right edge) of the track (112). The track may be sloped at any suitable angle or distance to provide the desired amount of assistance without causing the door to close too quickly due to the slope.

The track may span a distance equal to approximately twice the length of the doorway (129) to allow the door (116) to transition between a closed position where the doorway (129) is substantially entirely covered (as shown in FIG. 1) and an open position where the doorway (129) is substantially entirely open. The door (116) may also be positioned in an intermediate position along the track (112) between the closed position and the open position wherein the doorway (129) is partially open and partially covered by the door (116). In the illustrated embodiment, the track (112) also has a door stop (104) at each end to limit the distance the door is allowed to travel along the track (112) and prevent the rollers (101) from exiting the track (112) during normal use.

In addition to providing an attachment point and support for the track (112), the header (113) can also provide support and an attachment point for other components of the door system (100), such as an electrical junction box (102). As shown, the electrical junction box (102) is attached to the header (113) at the opening end of the header (113). Thus, in the illustrated embodiment, which depicts a door system (100) installed in a SRO orientation, the electrical junction box (102) is installed on the right side of the header (113). In other embodiments where the door system is installed in a SLO orientation, the electrical junction box may be installed on the left side of the header because, in those embodiments, the left side of the header is the opening end of the header.

In this embodiment, the electrical junction box (102) is electrically connected to a panel-mounted electrical box (108) via a cable (106). As shown, panel-mounted electrical box (108) is mounted on the front surface of the door and is positioned adjacent to the upper edge of the door (116) at about the midpoint of the width of the door (116). Placement of the panel-mounted electrical box (108) at about the midpoint of the width of the door (116) may allow the door (116) to be installed in either a SRO orientation or a SLO orientation without having to modify or move the panel-mounted electrical box (108) or modify any electrical wiring connected to the panel-mounted electrical box (108). Locating the electrical junction box (102) at the opening end of the header (113) may prevent an electrical cable extending between electrical junction box (102) and panel-mounted electrical junction box (108), such as cable (106), from hanging across the doorway (129) when the door (116) is in the open position or traveling towards the open position. It will be appreciated that cable (106) can be any suitable electrical cable, including but not limited to an SJO cable or a 4-wire coiled cable.

In the illustrated embodiment, door system (100) also includes two vertical casing members (114, 115). Vertical casing members (114, 115) may extend along substantially the entire height of the doorway (129). As shown, one vertical casing member (114, 115) is installed with along each edge of the doorway (129), with each casing member (114, 115) engaging in the header (113) via locator pins that help guide the casing member (114, 115) into proper position relative to the header (113) and, thus, facilitates installation of the casing members (114, 115). In this embodiment, a closing edge vertical casing member (114) is installed adjacent to the closing edge of the door (116) when the door (116) is in the closed position and an opening edge vertical casing member (115) is installed adjacent to the opening edge of the door (116) when the door (116) is in the closed position. Each vertical casing member (114, 115) can be configured to allow it to be flipped and installed at either the left or right edge of the doorway (129) depending on if the door system (100) is to be installed in a SRO orientation or a SLO orientation, as will be described in more detail below. Closing edge vertical casing member (114) may also have additional features specific to the closing edge of the door (116) such as a breaker bar strike plate or reinforcement plate, lock mechanisms, or other features. Each vertical casing member (114, 115) may also comprise vertical rubber gaskets or sweeps attached to a respective casing member (114, 115) configured to create a seal between the door (116) and the casings (114, 115) when the door is closed, but still allow the door (116) to slide to open when needed.

Figure 3:
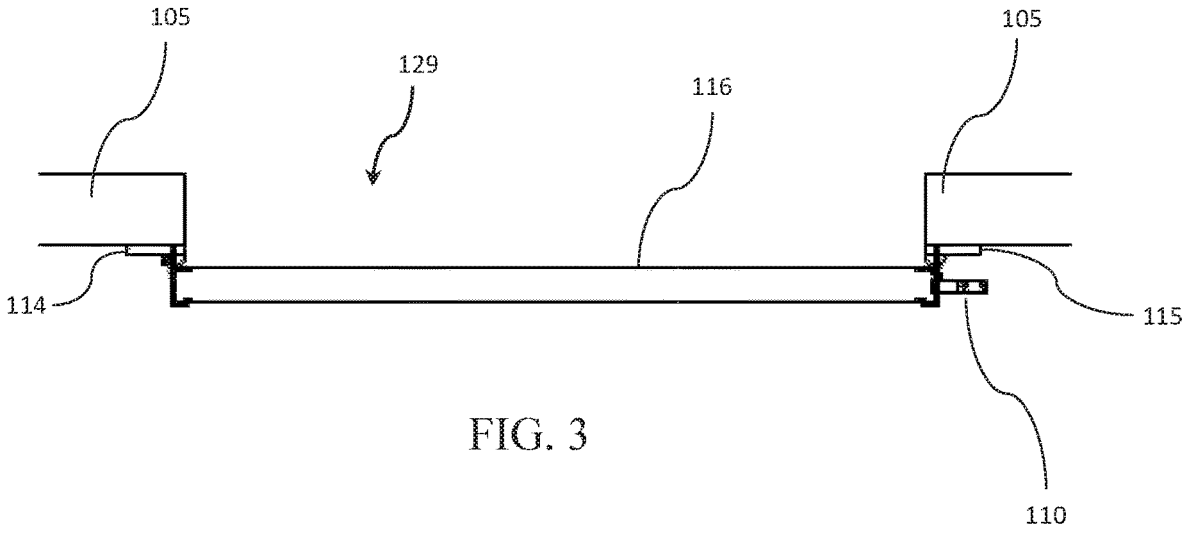
FIG. 3 depicts a top cross-sectional view of the system of FIG. 1 taken along the line 3-3.
Figure 4:
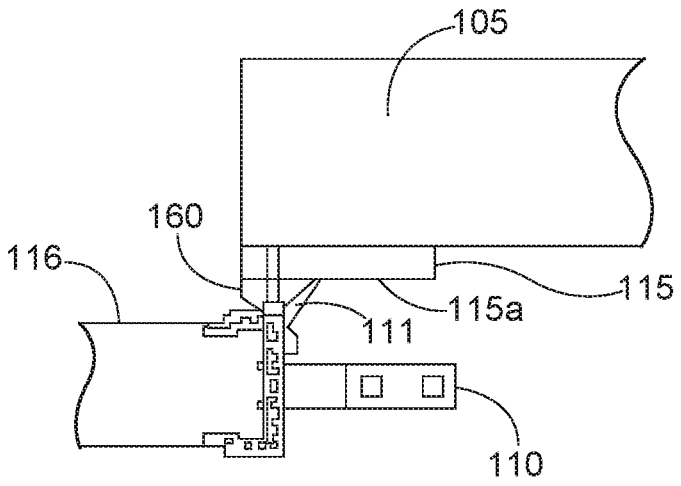
FIG. 4 depicts a partial top cross-sectional view of the right side of the system of FIG. 1 taken along the line 4-4.

In the illustrated embodiment, door system (100) also includes a floor guide (110) that the door (116) engages along the bottom edge of the door (116). Floor guide (110) may be configured to prevent the door (116) from swinging towards or away from the doorway (129) when hanging or sliding. The floor guide (110) may be positioned to help keep the door (116) a desired distance away from the vertical casing members (114, 115) to maintain a seal around the door (116) when the door (116) is in the closed position. In the embodiment shown in FIG. 3, the floor guide (110) is installed on the floor and in front of the wall such that at least a portion of the floor guide (110) is underneath the opening edge of the door (116) when the door (116) is in the closed position. In some embodiments, an end of the floor guide (110) may be substantially aligned with an edge of the doorway (129). For example, when the door system (100) is installed in a SRO orientation, an end of the floor guide (110) may be substantially aligned with the right edge of the doorway (129), while when the door system (100) is installed in a SLO orientation, an end of the floor guide (110) may be substantially aligned with the left edge of the doorway (129). The floor guide (110) may be positioned adjacent to, but not in front of, the doorway (129) so that the floor guide (110) does not block the doorway (129) when the door (116) is in the open position. As best seen in FIGS. 3 and 4, in this embodiment, a portion of the floor guide (110) that includes mounting apertures configured to receive fasteners to secure the floor guide (110) to the floor extends beyond the opening edge of the door (116) toward the open position when the door (116) is in the closed position.

The door (116) may also have additional features, including but not limited to an exterior handle (118), a kick plate (120), rubber sweeps or gaskets at one or both of the top and bottom to aid in maintaining a seal around the edges of the door (116) when it is in the closed position, alarms or sensors for determining and alerting when the door is opened or closed, and other features that may be apparent to one of ordinary skill in the art in light of the disclosure herein.

In the embodiment shown in FIG. 4, the opening edge vertical casing member (115) is affixed to the wall (105) and has a seal block (160) attached to its front face (115*a*). As shown, the seal block (160) comprises a side surface (163), a connecting surface (165), a front surface (167), and a sealing surface (169). As shown, the side surface (163) faces the doorway (129) and is substantially flush with the vertical edges of the opening edge vertical casing member (115) and the wall (105)/doorway (129) when the opening edge vertical casing member (115) is installed. The connecting surface (165) is oriented at an oblique angle relative to the side surface (163) and connects the side surface (163) to the front surface (167). The front surface (167) is substantially perpendicular to the side surface (163) and substantially parallel to the front face (115*a*) of opening edge vertical casing member (115). The front surface (167) is configured to contact the rear surface of the door (116). The sealing surface (169) is oriented at an oblique angle relative to the front surface (167) and extends from the front surface (167) to the face (115*a*) of the opening edge vertical casing member (115). The sealing surface (169) is configured to contact an opening edge gasket (111) that is attached the door (116) when the door (116) is in the closed position, thereby creating a seal along the opening edge of the door (116) and mitigating air flow between the areas located on opposite sides of the door (116) when the door (116) is in the closed position. In this embodiment, the opening edge gasket (111) is attached to the opening edge of the door (116) and travels with the door (116) away from the seal block (160) when the door (116) travels from the closed position to the open position. The opening edge gasket (111) may comprise any material suitable to create the desired seal with seal block (160) and withstand the stresses of use, including but not limited to rubber.

Figure 5:
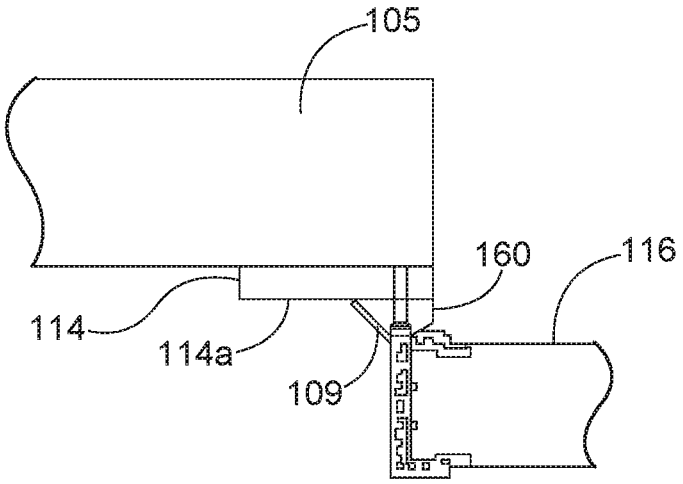
FIG. 5 depicts a partial top cross-sectional view of the left side of the system of FIG. 1 taken along the line 5-5.

In the embodiment shown in FIG. 5, the closing edge vertical casing member (114) is affixed to the wall (105) and has a seal block (160) attached to its front face (114*a*) that is substantially similar to the seal block (160) described above, except that the seal block (160) attached to the closing edge vertical casing member (114) has a closing edge gasket (109) attached thereto. The closing edge gasket (109) may comprise any material suitable to create the desired seal with the closing edge of door (116) and withstand the stresses of use, including but not limited to rubber. As shown, the seal block (160) attached to the closing edge vertical casing member (114) also comprises a side surface (163), a connecting surface (165), a front surface (167), and a sealing surface (169). In this embodiment, the side surface (163) faces the doorway (129) and is substantially flush with the vertical edges of the closing edge vertical casing member (114) and the wall (105)/doorway (129) when the closing edge vertical casing member (114) is installed. The connecting surface (165) is oriented at an oblique angle relative to the side surface (163) and connects the side surface (163) to the front surface (167). The front surface (167) is substantially perpendicular to the side surface (163) and parallel to the front face (114*a*) of closing edge vertical casing member (114). The front surface (167) is configured to contact the rear surface of the door (116). The sealing surface (169) is oriented at an oblique angle relative to the front surface (167) and extends from the front surface (167) to the face (114*a*) of the closing edge vertical casing member (114). As mentioned above, in this embodiment, the closing edge gasket (109) is attached to the seal block (160) and configured to contact the closing edge of the door (116) when the door (116) is in the closed position, thereby creating a seal along the closing edge of the door and mitigating air flow between the areas located on opposite sides of the door (116) when the door (116) is in the closed position. In the illustrated embodiment, the closing edge gasket (109) is attached to the sealing surface (169) of the seal block (160). The closing edge gasket (109) can be attached to the seal block (160) using conventional fasteners or any other suitable method or component. In some embodiments, the seal block (160) attached to the closing vertical casing member (114) may also include a gasket retainer configured to retain at least a portion of the closing edge gasket (109). The gasket retainer may comprise any suitable material, including but not limited to stainless steel.

The seal blocks (160) attached to either vertical casing member (114, 115) may also be referred to within the industry as vertical wear rails. In addition, the seal blocks (160) may comprise any material suitable to create the desired seal and withstand the stresses of use, including but not limited to a hard plastic or rubber, such as high-density polyethylene (HDPE). In addition, the seal block (160) attached to either vertical casing member (114, 115) is preferably attached to the respective vertical casing member (114, 115) using conventional fasteners, although other suitable methods or components, including but not limited to an adhesive, may be used in some embodiments to attach the seal block (160) to the respective vertical casing member (114, 115).

Figure 6:
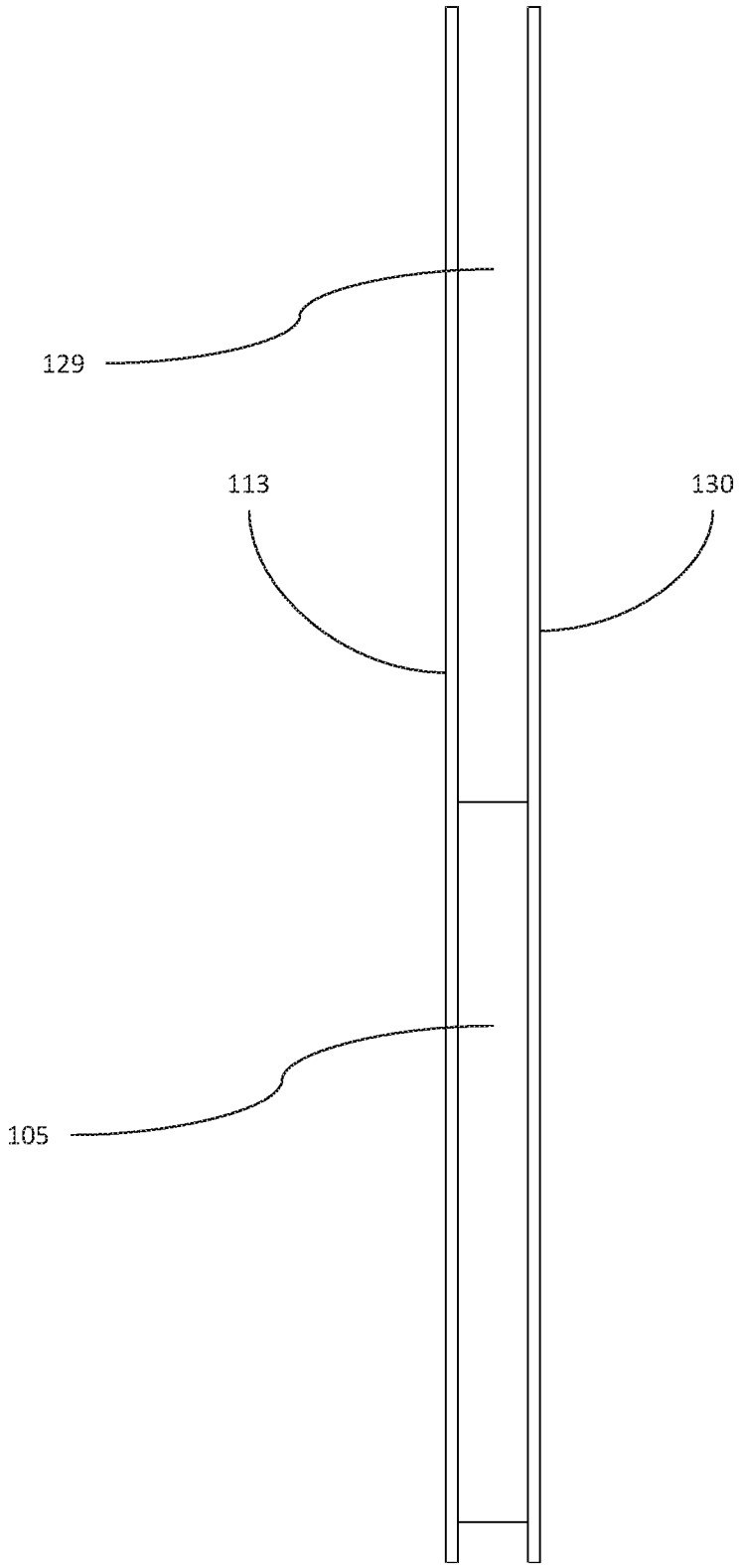
FIG. 6 depicts a top view of an exemplary embodiment of a front header and mirror header surrounding a wall section.

As shown in FIG. 6, in some embodiments, the door system may comprise both a front header (113) and a mirror header (130) that are positioned on either side of the doorway (129) and wall (105). The mirror header (130) may be utilized in certain applications, including but not limited to, if the door system (100) is being installed on a non-structural wall. In such an embodiment, the door (116) and track (112) may be installed on the front header (113). The mirror header (130) may be installed on the opposite face of the wall (105) such that it is substantially aligned with the front header (113). Connectors may be inserted through the wall to connect the front header (113) and the mirror header (130) to each other to help provide additional support for the door (116) and track (112). The connectors may comprise bolts, conventional fasteners, or any other suitable components or methods for securing the front header (113) to the mirror header (130). In some embodiments, the system (100) may also include mirror vertical casing members installed on the opposite side of the wall and aligned with vertical casing members (114, 115) in addition to a mirror header (130).

Figure 7:
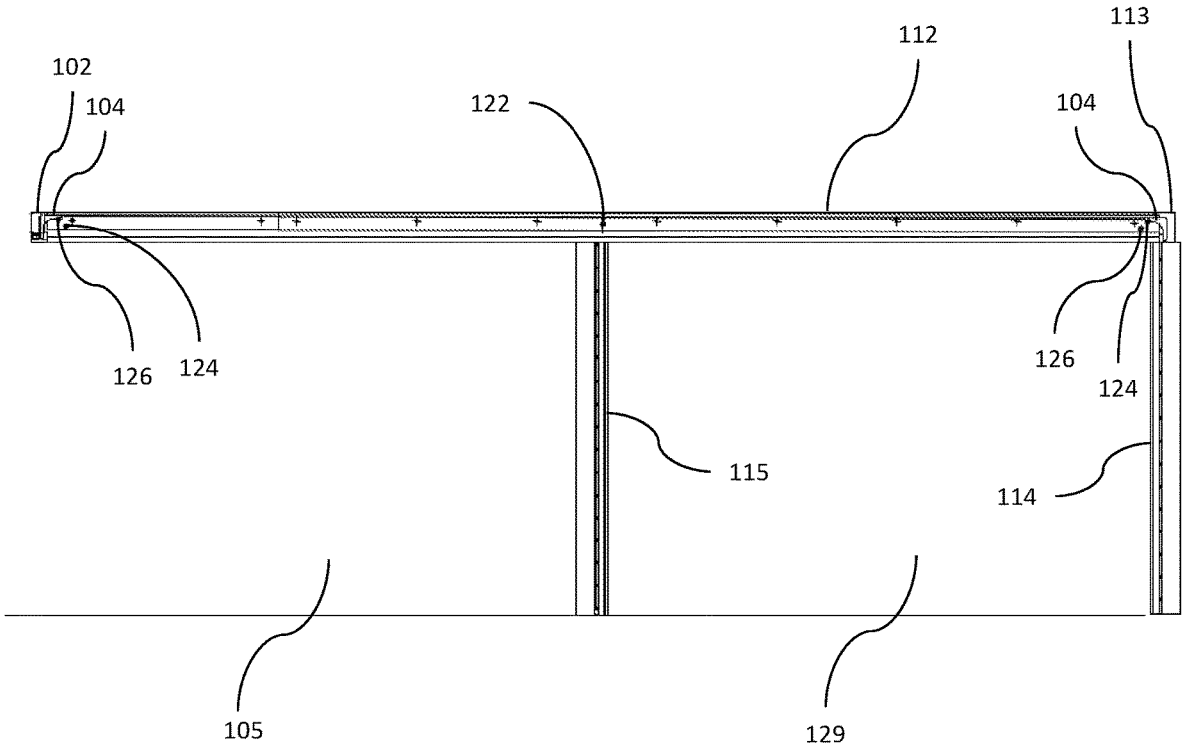
FIG. 7 depicts a front elevation view of an exemplary embodiment of a header, track and vertical casing member of a universal door system installed in a SLO orientation.

FIG. 7 depicts sliding door system (100) installed in a SLO orientation. The door (116) and rollers (101) are not shown for clarity. In this embodiment, door system (100) includes a pivot connection (122) which is a connection point between the track (112) and the header (113) that allows the track (112) to pivot about a connector, such as a conventional mounting bolt or other suitable fastener, relative to the header (113) when all other connectors between the track (112) and header (113) are removed. Pivot connection (122) may be located at about the midpoint of the track (112). In embodiments where the track (112) comprises a single track member, then the pivot connection (122) may be located at about the midpoint of the single track member. In other embodiments, where the track (112) comprises two or more track members, the pivot connection (122) may be located at about the midpoint of the overall length of the track (122) (i.e., at about the midpoint of the combined length of all of the track members that make up the track (122)). In some embodiments, the pivot connection (122) may also be located at about the midpoint of the header (113). In some embodiments, one or both of the track (112) and the header (113) may comprise a predrilled hole or a location indicator (e.g., marking, dimple, etc.) to indicate where the pivot connection (122) should be located. The location indicator may facilitate creation of the desired through-hole in one or both of the track (112) and the header (113) on-site as opposed to the hole being predrilled at the factory. In embodiments where both the track (112) and the header (113) include an opening for the pivot connection (122), the openings may be aligned during installation of the track (112) onto header (113). Whether the opening for pivot connection (122) comprises a predrilled hole or a location indicator and a through hole for pivot connection (122) is created on-site, a connector can be inserted through track (112) and header (113) to create pivot connection (122).

As discussed above, in some embodiments, the track (112) may be angled relative to the header (113) so that the track (112) slopes downward from its opening edge to its closing edge. Pivot connection (122) allows for the closing edge of the track (112) to be quickly and easily lowered relative to the opening edge of the track (112) before the track (112) is reattached to the header (113). Thus, regardless of which way the track (112) was originally installed, the slope can be adjusted quickly and easily if the direction of opening needs to be reversed.

As shown in FIGS. 7-16, track (112) and header (113) may comprise a dual connection system configured to facilitate installation of the door system (100) in either a SRO orientation or a SLO orientation. The dual connection system may comprise a plurality of openings along both the track (112) and the header (113) configured to receive connectors, which may comprise bolts, conventional fasteners, or any other suitable components or methods for securing the track (112) to the header (113). Specifically, the dual connection system may comprise at least a first plurality of openings arranged to allow the track (112) to be angled for a SRO orientation and a second plurality of openings arranged to allow the track (112) to be angled for a SLO orientation. The openings may comprise predrilled holes or location indicators (e.g., markings, dimples, etc.), or combinations thereof, to indicate where the connectors should be installed for the track (112) to have the desired angle. Use of location indicators may facilitate creation of the desired through-holes in one or both of the track (112) and the header (113) on-site as opposed to the holes being predrilled at the factory. Each plurality of openings may be arranged at an angle so that the opening adjacent to the closing end of the track (112) or header (113) is lower than the opening adjacent to the opening end of the track (112) or header (113). In some embodiments, at least some of the openings in the track (112) and the header (113) may overlap so that they can be aligned to allow a connector to go through both the track (112) and the header (113). In other embodiments, at least some of the openings in the track (112) may not have a corresponding opening in the header (113). However, in those embodiments, the installer may use the openings in the track (112) as a guide or locator and drill corresponding openings in the header (113) to allow a connector to go through both the track (112) and the header (113).

By way of example only, the SRO plurality of openings (i.e., the plurality of openings that receive a fastener when the track (112) is installed in an SRO orientation) may be arranged so that the left-most SRO opening on the track (112) or header (113) is lower than the right-most SRO opening on the track (112) or header (113). Alternatively, by way of example only, the SLO plurality of openings (i.e., the plurality of openings that receive a fastener when the track (112) is installed in an SLO orientation) may be arranged so that the right-most SLO opening on the track (112) or header (113) is lower than the left-most SLO opening on the track (112) or header (113). Use of a respective plurality of openings to attach the track (112) to the header (113) may be mutually exclusive to simplify installation. In other words, in those embodiments, the installer would either use the SRO plurality of openings or the SLO plurality of openings depending on the desired opening orientation. In some embodiments, the opening for the pivot connection (122) may be the same regardless of whether the door system (100) is installed in either a SRO orientation or a SLO orientation. To install the track (112), assuming there are not any connectors inserted in either the SRO plurality of openings or the SLO plurality of openings, the installer can pivot the track (113) about the pivot connection (122) so that it is angled in accordance with the desired opening orientation and then insert the connectors into either the SRO plurality of openings or the SLO plurality of openings depending on the desired opening orientation.

For example, in embodiments where the door system (100) is to be installed in a SRO orientation, the track (112) can be pivoted about the pivot connection (122) so that the closing end (i.e., left end) of the track (112) is lower than the opening end (i.e., right end) of the track (112). After the track (112) is pivoted and the track (112) is aligned at the desired angle, connectors can be inserted into at least some of the SRO plurality of openings in the track (112) and header (113) to attach the track (112) to the header (113). In embodiments where the door system (100) is to be installed in a SLO orientation, the track (112) can be pivoted about the pivot connection (122) so that the closing end (i.e., right end) of the track (112) is lower than the opening end (i.e., left end) of the track (112). After the track (112) is pivoted and the track (112) is aligned at the desired angle, connectors can be inserted into at least some of the SLO plurality of openings in the track (112) and the header (113) to attach the track (112) to the header (113). If the holes for the SRO and SLO plurality of openings have not yet been created, then holes for those openings can be drilled into the track (112) and header (113) as required.

Figure 8:
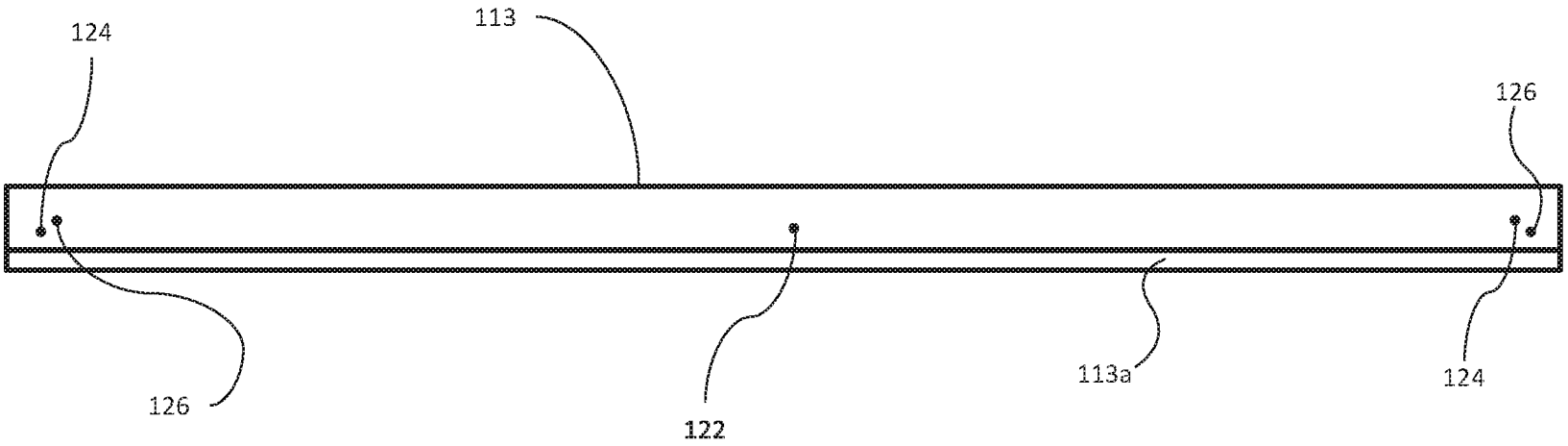
FIG. 8 depicts a front elevation view of an exemplary header for system use with the universal sliding door system of FIG. 1.

In the embodiment shown in FIG. 8, header (113) includes a first plurality of openings (124) or SRO openings arranged to allow track (112) to be installed in a SRO orientation and a second plurality of openings (126) or SLO openings arranged to allow track (112) to be installed in a SLO orientation. As shown, header (113) includes a substantially central opening for pivot connection (122) and each plurality of openings (124, 126) includes an opening a lower opening and a higher opening on opposite ends of the header (113). In some embodiments, the hole for the central opening for pivot connection (122) and the holes for the other plurality of openings (124, 126) in the header (113) may be predrilled, while holes for other openings in the header (113) configured to be used to secure the track (112) to the header (113) and/or to secure the header or the header track assembly (i.e., an assembly comprising the header (113) and the track (112), once those two components have been attached to each other) to the wall (105) may be drilled on-site.

In some embodiments, the header (113) may also include a first set of electrical junction box mounting openings on one end of the header (113) and a second set of electrical junction box mounting openings on the other end of the header (113). The first and second sets of electrical junction box mounting openings may be configured to allow an electrical junction box, such as electrical junction box (102), to be easily installed on either end of the header (113) depending on the desired opening orientation. As discussed above, locating the electrical junction box (102) at the opening end of the header (113) may prevent an electrical cable extending between electrical junction box (102) and panel-mounted electrical junction box (108), such as cable (106), from hanging across the doorway (129) when the door (116) is in the open position or traveling towards the open position. Thus, it may be beneficial for the electrical junction box (102) to be able to be easily installed on either end of the header (113). The openings may comprise predrilled holes or location indicators (e.g., markings, dimples, etc.), or combinations thereof, to indicate where the electrical junction box (102) should be installed. Use of location indicators may facilitate creation of the desired through-holes in the header (113) on-site as opposed to the holes being predrilled at the factory.

In some embodiments, the header (113) may also include a top gasket system (113*a*) installed along substantially the entire length of the header (113) (i.e., at least along the length of the header traveled by the door (116) as it travels from a fully closed position to a fully opened position) in order to facilitate the installation of the door system (100) in either orientation. In some embodiments, the top gasket system (113*a*) may comprise a gasket mounted to a seal block or wear rail attached to the header. The seal block may be similar to seal blocks (160) described herein or have any other suitable cross-section, including but not limited to a rectangular or square cross-section. The gasket may be mounted to the seal block with a clamp strip and fasteners. In some embodiments, the gasket may comprise any material suitable to create the desired seal with the upper edge of the door (116) and withstand the stresses of use, including but not limited to rubber and the clamp strip may comprise fiberglass or any other suitable material. The top gasket system (113*a*) engages the top edge of the door (116) when the door is in the closed position to create a seal along the top edge of the door (116). Installing the top gasket system (113*a*) along the entire length of the header (113) may result in a seal along the top edge of the door (116) regardless of where the door is positioned along the header (113). As a result, the door system (100) can be installed in either a SRO or SLO orientation and the top gasket system (113*a*) will create a seal along the top edge of the door (116) when the door (116) is in the closed position.

FIGS. 9-16 depict an embodiment of track (112). In this embodiment, the track (112) comprises a first leg (135) and a second leg (137). As shown, the first leg (135) and the second leg (137) are arranged substantially perpendicularly relative to each other. In this embodiment, the first leg (135) is attached to the header (113) and the second leg (137) includes a channel configured to receive the rollers (101) from which the door (116) is suspended. Upon installation, the first leg (135) may be oriented substantially vertically, while the second leg (137) may be oriented substantially horizontally.

Figure 9:
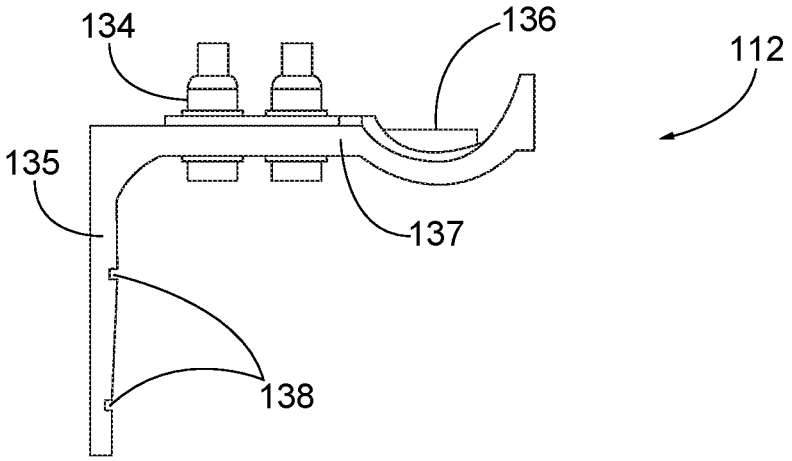
FIG. 9 depicts a side elevation view of an exemplary embodiment of a track for use with the universal sliding door system of FIG. 1 with a hold close bracket installed.
Figure 10:
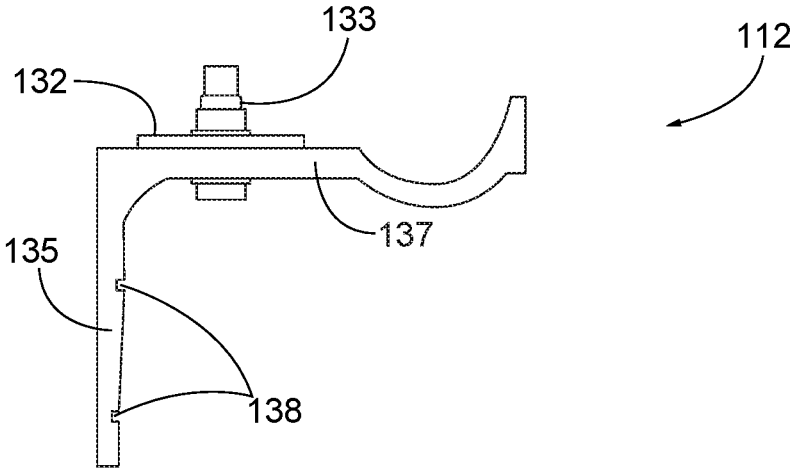
FIG. 10 depicts a side elevation view of the track of FIG. 9 with a splice plate joining a first track member and a second track member.
Figure 11:
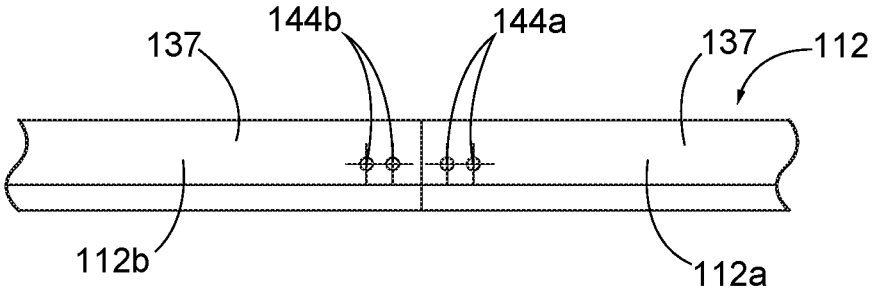
FIG. 11 depicts a partial top plan view of the track of FIG. 10.
Figure 12:
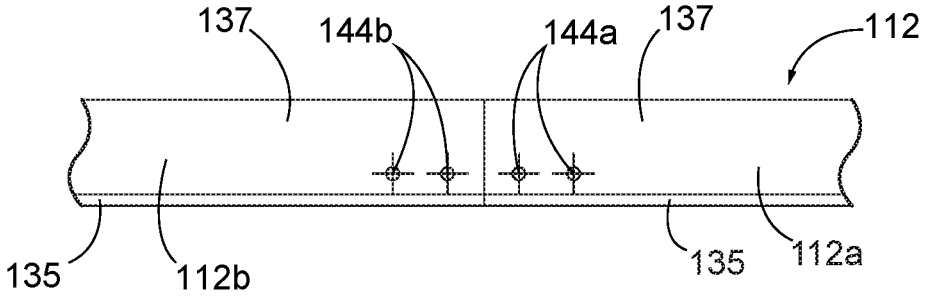
FIG. 12 depicts a partial bottom plan view of the track of FIG. 10.

FIG. 9 depicts a portion of the track (112) with a hold close bracket (136) installed on the second leg (137) of the track (112). The hold close bracket (136) may be attached to the track (112) with one or more connectors (134), which may comprise bolts, conventional fasteners, or any other suitable components or methods for securing the hold close bracket (136) to the track (112). The hold close bracket (136) may be configured to help keep the door (116) closed thereby maintaining the seals around the edges of the door (116) when the door (116) is in the closed position. The hold close bracket (136) may be installed adjacent to the closing edge of the track (112). Accordingly, the hold close bracket (136) may be installed on either end of the track (112) depending on the desired opening orientation. In order to facilitate installation of the door system (100) in either opening orientation, the track (112) may have a first set of hold close bracket mounting openings on one end of the track (112) and a second set of hold close bracket mounting openings on the other end of the track (112). The first and second sets of hold close bracket mounting openings may be configured to allow hold close bracket (136) to be easily installed on either end of the track (112) depending on the desired opening orientation. The openings may comprise predrilled holes or location indicators (e.g., markings, dimples, etc.), or combinations thereof, to indicate where the hold close bracket (136) should be installed. Use of location indicators may facilitate creation of the desired through-holes in the track (112) on-site as opposed to the holes being predrilled at the factory.

In some embodiments, including the embodiment depicted in FIGS. 10-16, the track (112) may comprise two or more pieces of track attached to each other. In the illustrated embodiment, a first track member (112*a*) is attached to a second track member (112*b*) with a splice plate (132) positioned over the joint between the first track member (112*a*) and the second track member (112*b*). The splice plate (132) may be attached to the track members (112*a*, 112*b*) with one or more connectors (133), which may comprise bolts, conventional fasteners, or any other suitable components or methods for securing the splice plate (132) to the track members (112*a*, 112*b*). For example, the splice plate may be positioned over the joint between the track members (112*a*, 112*b*) and one or more connectors (133) may be inserted through the second leg (137) of each track member (112*a*, 112*b*) on either side of the joint to secure the splice plate (132) to the track members (112*a*, 112*b*) and secure the track members (112*a*, 112*b*) to each other. In some embodiments, first track member (112*a*) may have a first set of splice plate mounting openings (144*a*) on one end of the track member (112*a*) and second track member (112*b*) may have a second set of splice plate mounting openings (144*b*) on a corresponding end of the second track member (112*b*). The first and second sets of splice plate mounting openings (144*a*, 144*b*) may be configured to allow splice plate (132) to be easily installed at the joint between the first track member (112*a*) and the second track member (112*b*). The openings (144*a*, 144*b*) may comprise predrilled holes or location indicators (e.g., markings, dimples, etc.), or combinations thereof, to indicate where the splice plate (132) should be installed. Use of location indicators may facilitate creation of the desired through-holes in the track members (112*a*, 112*b*) on-site as opposed to the holes being predrilled at the factory.

Figure 13:
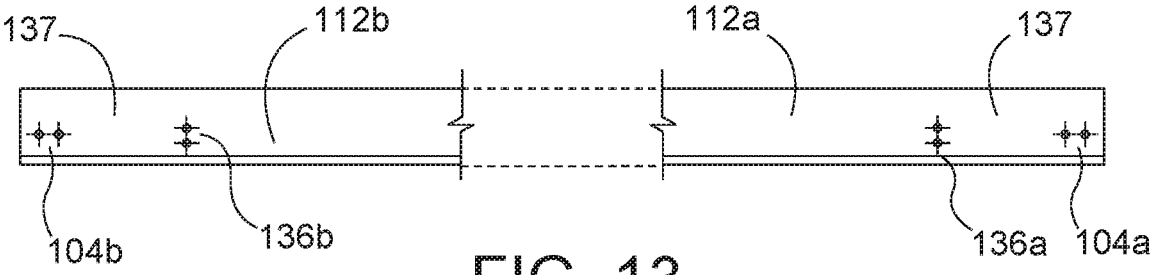
FIG. 13 depicts a partial bottom plan view of the two ends of the track of FIG. 10.

As mentioned above, in some embodiments, the track (112) may have a first set of hold close bracket mounting openings on one end of the track (112) and a second set of hold close bracket mounting openings on the other end of the track (112). The first and second sets of hold close bracket mounting openings may be configured to allow a hold close bracket (136) to be easily installed on either end of the track (112) depending on the desired opening orientation. FIG. 13 depicts such an embodiment. As shown in FIG. 13, first track member (112*a*) includes a first set of hold close bracket mounting openings (136*a*) and second track member (112*b*) includes a second set of hold close bracket mounting openings (136*b*). In addition, in the embodiment shown in FIG. 13, the first track member (112*a*) also includes a first set of door stop openings (104*a*) and the second track member (112*b*) also includes a second set of door stop openings (104*b*) configured to allow door stops (104) to be installed on both ends of the track (112).

Figure 14:
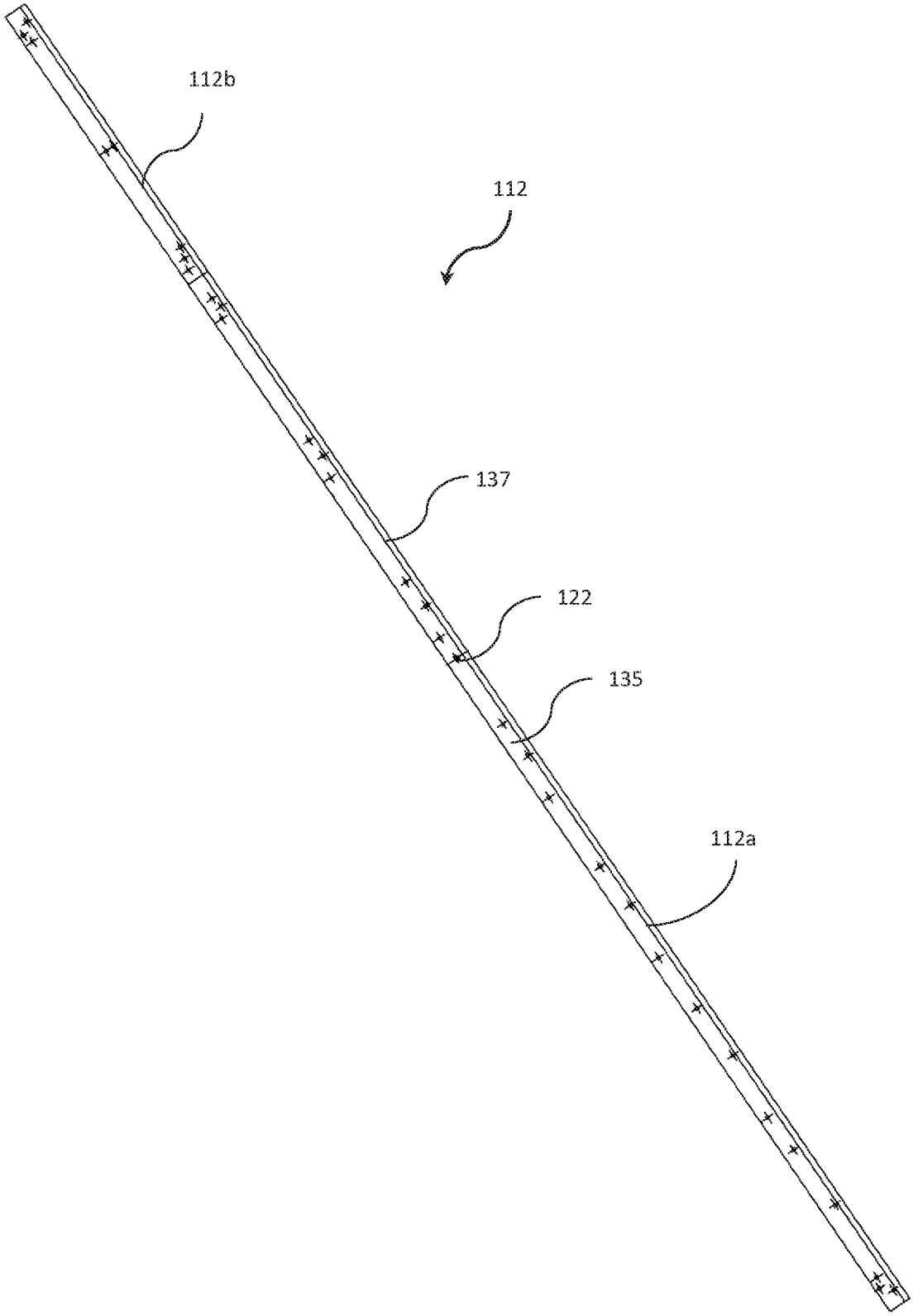
FIG. 14 depicts a front elevation view of the track of FIG. 10.
Figure 15:
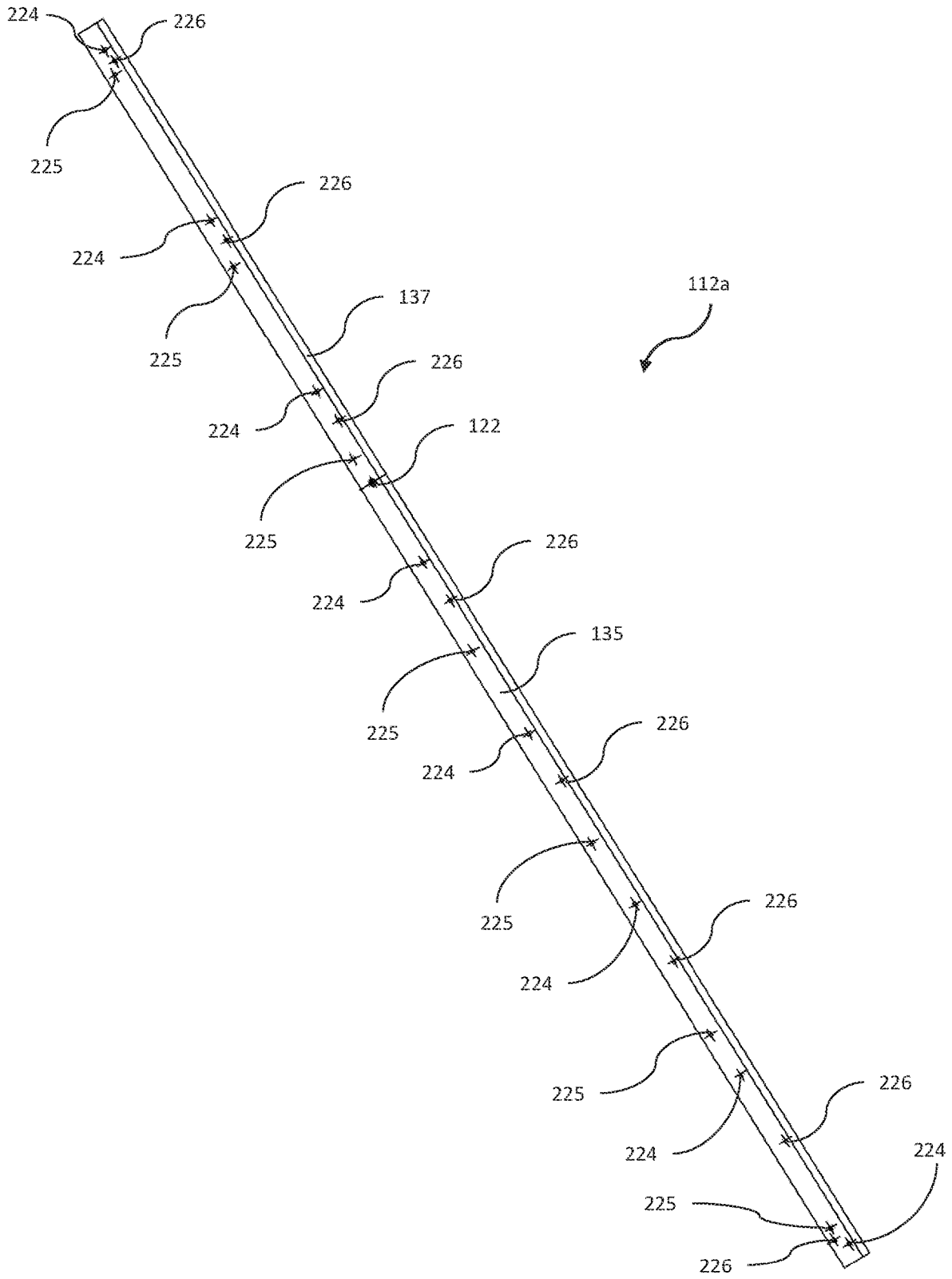
FIG. 15 depicts a front elevation view of the first track member of the track of FIG. 10.
Figure 16:
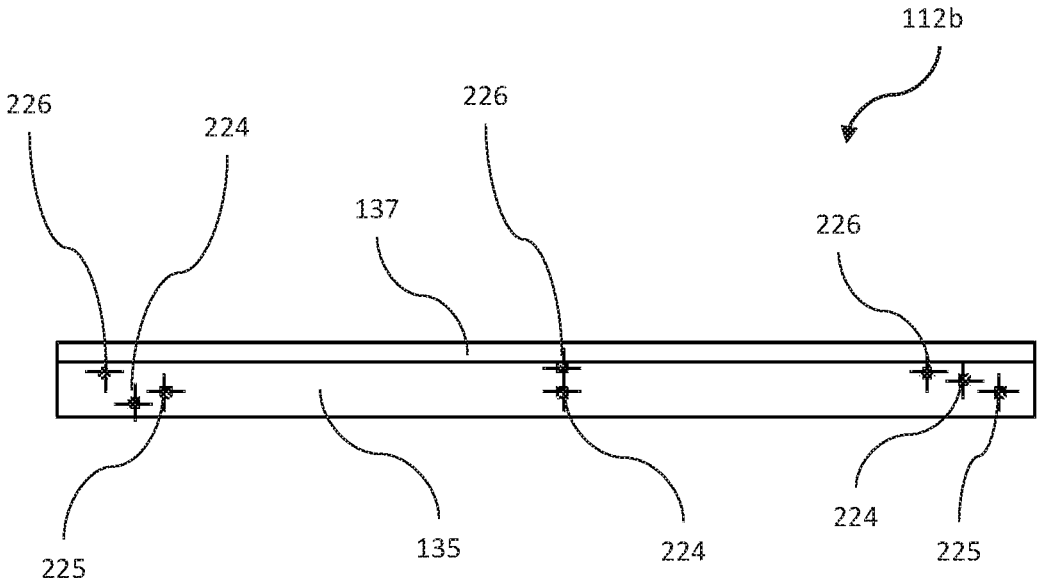
FIG. 16 depicts a front elevation view of the second track member of the track of FIG. 10.

As shown in FIG. 14 and discussed above, the track (112) comprises a first track member (112*a*) and a second track member (112*b*). In this embodiment, the first track member (112*a*) is longer than the second track member (112*b*). In some embodiments, the first track member (112*a*) and the second track member (112*b*) may be of substantially equal length.

In the illustrated embodiment, both track members (112*a*, 112*b*) include first plurality of openings (224) or SRO openings arranged to allow track (112) to be installed in a SRO orientation and a second plurality of openings (226) or SLO openings arranged to allow track (112) to be installed in a SLO orientation. For example, each respective plurality of openings (224, 226) may be arranged such that the opening closest to the closing edge of the track (112) orientation is lower than the opening closest to the opening edge of the track (112), resulting in the track (112) being slanted downward from the opening edge of the track (112) towards the closing edge of the track (112). One or more of the first plurality of openings (224) in the track members (112*a*, 112*b*) may correspond to one or more of the first plurality of openings (124) in the header (113) when the track (112) is attached to the header (113) in a SRO orientation. Similarly, one or more of the second plurality of openings (226) in the track members (112*a*, 112*b*) may correspond to one or more of the second plurality of openings (126) in the header (113) when the track (112) is attached to the header (113) in a SLO orientation. In some embodiments, the first leg (135) of the track (112) may comprise one or more grooves (138). In such an embodiment, the first plurality of openings (224) may be aligned with a first one of the grooves (138) and the second plurality of openings (226) may be aligned with a second one of the grooves (138). The openings in the first and second pluralities of openings (224, 226) may comprise predrilled holes or location indicators (e.g., markings, dimples, etc.), or combinations thereof, to indicate where the connectors should be inserted to attach the track (112) to the header (113). Use of location indicators may facilitate creation of the desired through-holes in the track (112) and/or header (113) on-site as opposed to the holes being predrilled at the factory.

In the illustrated embodiment, the track members (112*a*, 112*b*) each also include a third plurality of openings (225) comprising a plurality of through-holes. The third plurality of openings (225) may facilitate the installation of additional connectors to secure the header track assembly to the wall (105) and, in some embodiments, to a corresponding mirror header (130) installed on the opposite side or face of the wall (105). The connectors may comprise bolts, conventional fasteners, or any other suitable components or methods for securing the track (112) and the header (113) to the wall (105) and, in some embodiments, a corresponding mirror header (130). The third plurality of openings (225) may comprise predrilled holes or location indicators (e.g., markings, dimples, etc.), or combinations thereof, to indicate where the connectors should be inserted to attach the track (112) and the header (113) to the wall (105) and, in some embodiments, a corresponding mirror header (130). Use of location indicators may facilitate creation of the desired through-holes in the track (112) and/or header (113) on-site as opposed to the holes being predrilled at the factory.

Figure 17:
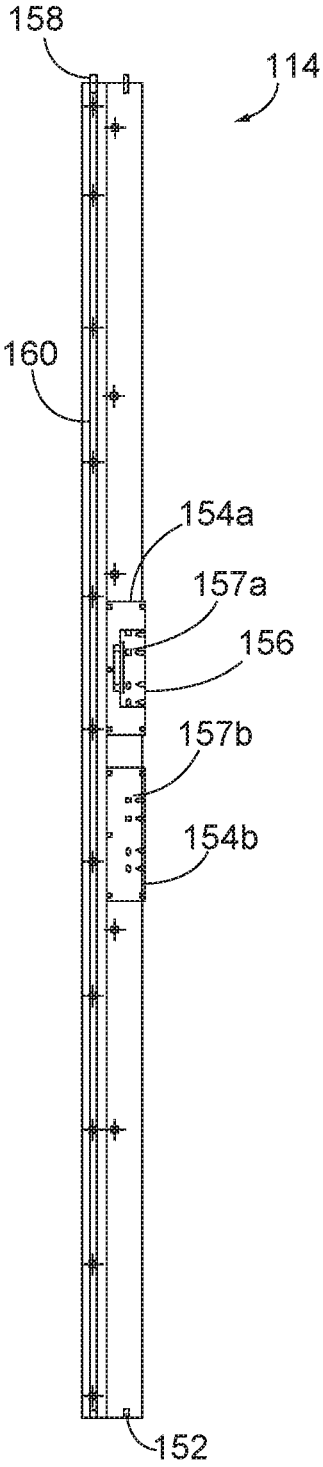
FIG. 17 depicts a front elevation view of an exemplary embodiment of a closing edge vertical casing member for use with the universal door system of FIG. 1.
Figure 18:
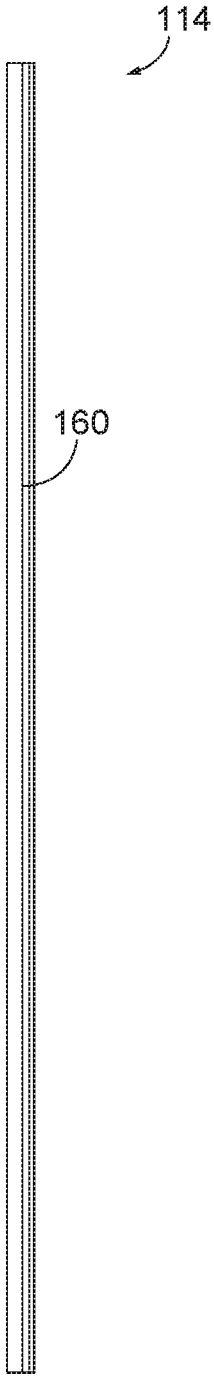
FIG. 18 depicts a side elevation view of the closing edge vertical casing member of FIG. 17.
Figure 21:
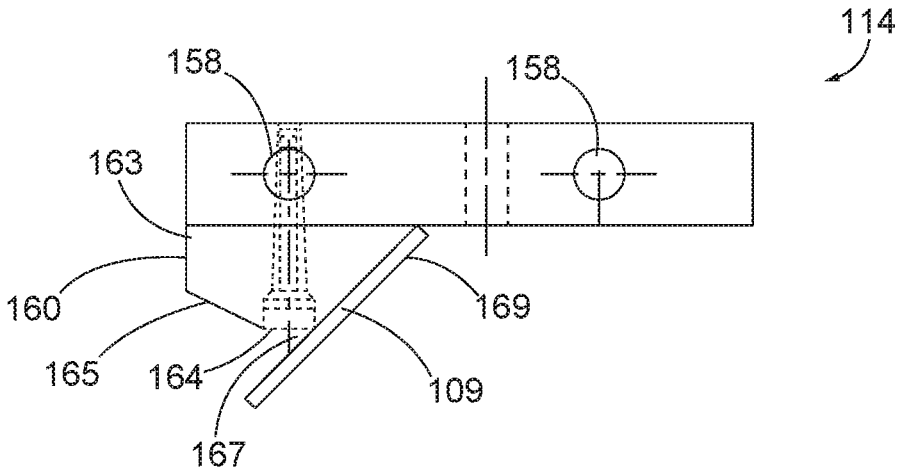
FIG. 21 depicts a top plan view of the closing edge vertical casing member of FIG. 17.

FIGS. 17, 18 and 21 depict an embodiment of closing edge vertical casing member (114). As shown, the closing edge vertical casing member (114) includes a pair of locator pins (158) installed on the top edge of the closing edge vertical casing member (114). The locator pins (158) may comprise dowels inserted into a corresponding opening in the top edge of the closing edge vertical casing member (114). The locator pins (158) may be removable from the corresponding opening in the closing edge vertical casing member (114). The locator pins (158) may be configured to engage corresponding openings in the header (113) to facilitate alignment and installation of the closing edge vertical casing member (114). In some embodiments, the closing edge vertical casing member (114) may also comprise one or more openings (152) in the bottom edge of the closing edge vertical casing member (114) that are also configured to receive the locator pins (158) if the closing edge vertical casing member (114) needs to be flipped during installation so that the side edge (163) of the seal block (160) remains facing the doorway (129), which allows the door system (100) to be installed in the opposite opening orientation. If the closing edge vertical casing member (114) needs to be flipped, then the locator pins (158) may be removed from the openings in the first end of the closing edge vertical casing member (114) and inserted into the openings in the second end of the closing edge vertical casing member (114) so the locator pins (158) can engage the header (113). As shown in FIG. 21, the seal block (160) may be attached to closing edge vertical casing member (114) with a connector (164). Connector (164) may be a conventional fastener or any other suitable device or method capable of attaching the seal block (160) to closing edge vertical casing member (114).

In some embodiments, the closing edge vertical casing member (114) may also include a first reinforcing plate (154*a*) and a second reinforcing plate (154*b*). The first and second reinforcing plates (154*a*, 154*b*) may comprise stainless steel or any other material configured to provide suitable strength to support use of a breaker bar. A breaker bar wall bracket (156) may be installed on either the first reinforcing plate (154*a*) or the second reinforcing plate (154*b*). The closing edge vertical casing member (114) may include a first plurality of breaker bar wall bracket mounting openings (157*a*) configured to allow the breaker bar wall bracket (156) to be installed on the first reinforcing plate (154*a*) and a second plurality of breaker bar wall bracket mounting openings (157*b*) configured to allow the breaker bar wall bracket (156) to be installed on the second reinforcing plate (154*b*). The openings in the first and second pluralities of breaker bar wall bracket mounting openings (157*a*, 157*b*) may comprise predrilled holes or location indicators (e.g., markings, dimples, etc.), or combinations thereof, to indicate where the connectors should be inserted to attach the breaker bar wall bracket (156) to the closing edge vertical casing member (114). Use of location indicators may facilitate creation of the desired through-holes in the closing edge vertical casing member (114) on-site as opposed to the holes being predrilled at the factory.

In the illustrated embodiment, the first reinforcing plate (154*a*) and first plurality of breaker bar wall bracket mounting openings (157*a*) are located above the second reinforcing plate (154*b*) and second plurality of breaker bar wall bracket mounting openings (157*b*). Such a configuration may allow the breaker bar wall bracket (156) to be easily installed in the correct location even if the closing edge vertical casing member (114) needs to be flipped to allow the door system (100) to be installed in the opposite opening orientation. The combination of a reinforcing plate (154*a*, 154*b*) and a breaker bar wall bracket (156) may provide a sturdy portion of the closing edge vertical casing member (114) which a breaker bar installed on the door (116) can push against to help break the seal around the door (116) when it is in the closed position and to provide leverage to help facilitate sliding of the door (116) from the closed position to an open position.

Figure 19:
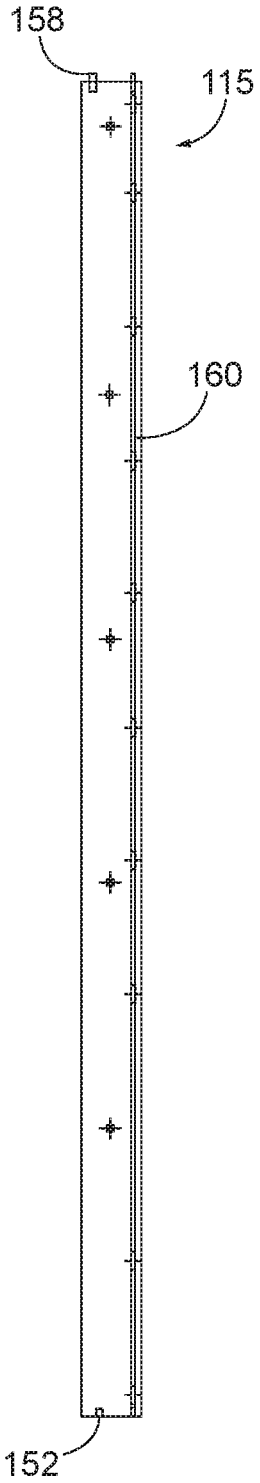
FIG. 19 depicts a front elevation view of an exemplary embodiment of an opening edge vertical casing member for use with the universal door system of FIG. 1.
Figure 20:
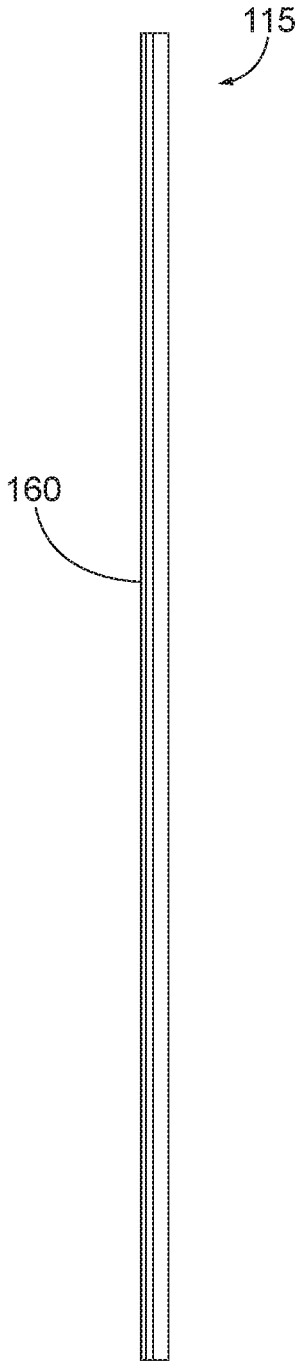
FIG. 20 depicts a side elevation view of the opening edge vertical casing member of FIG. 19.
Figure 22:
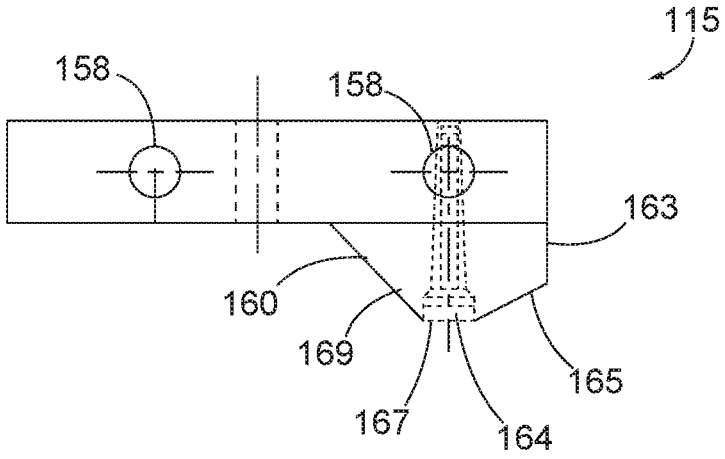
FIG. 22 depicts a top plan view of the opening edge vertical casing member of FIG. 19.

FIGS. 19, 20, and 22 depict an embodiment of opening edge vertical casing member (115). As shown, the opening edge vertical casing member (115) includes a pair of locator pins (158) installed on the top edge of the opening edge vertical casing member (115). The locator pins (158) may comprise dowels inserted into a corresponding opening in the top edge of the opening edge vertical casing member (115). The locator pins (158) may be removable from the corresponding opening in the opening edge vertical casing member (115). The locator pins (158) may be configured to engage corresponding openings in the header (113) to facilitate alignment and installation of the opening edge vertical casing member (115). In some embodiments, the opening edge vertical casing member (115) may also comprise one or more openings (152) in the bottom edge of the opening edge vertical casing member (115) that are also configured to receive the locator pins (158) if the opening edge vertical casing member (115) needs to be flipped during installation so that the side edge (163) of the seal block (160) remains facing the doorway (129), which allows the door system (100) to be installed in the opposite opening orientation. If the opening edge vertical casing member (115) needs to be flipped, then the locator pins (158) may be removed from the openings in the first end of the opening edge vertical casing member (115) and inserted into the openings in the second end of the opening edge vertical casing member (115) so the locator pins (158) can engage the header (113). As shown in FIG. 22, the seal block (160) may be attached to opening edge vertical casing member (115) with a connector (164). Connector (164) may be a conventional fastener or any other suitable device or method capable of attaching the seal block (160) to opening edge vertical casing member (115).

Figure 23:
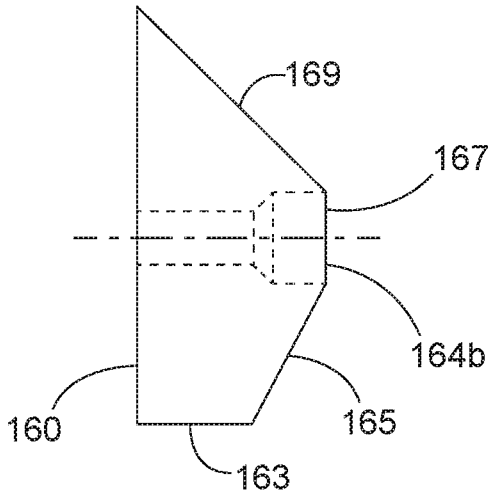
FIG. 23 depicts a side elevation view of an exemplary embodiment of a seal block for use with either the closing edge vertical casing member of FIG. 17 or the opening edge vertical casing member of FIG. 19.
Figure 24:
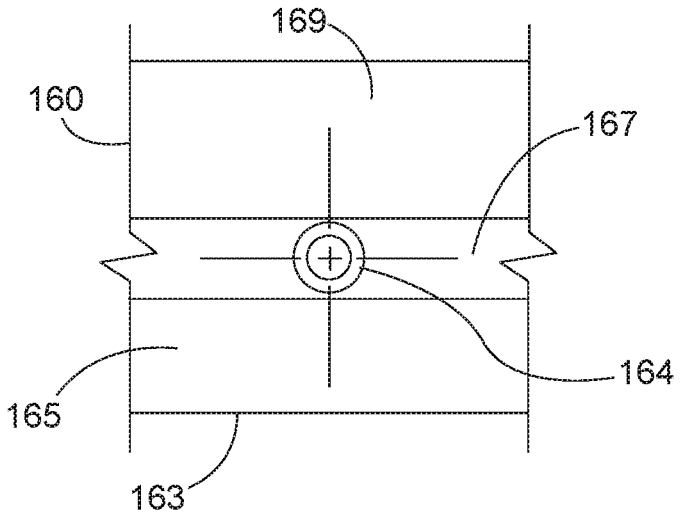
FIG. 24 depicts a top plan view of the seal block of FIG. 23.

FIGS. 23 and 24 depict an embodiment of seal block (160). In this embodiment, the seal block (160) comprises an opening (164*b*) configured to receive connector (164). Opening (164*b*) may extend from the front surface (167) through the body of the seal block (160).

FIGS. 25-33 depict another embodiment of a door (116) configured for use with the universal sliding door system (100) installed in a SLO orientation. Accordingly, when used as part of a door system (100) installed in a SLO orientation, the closing edge (176) of the door (116) is the right side of the door and the opening edge (168) of the door (116) is the left side of the door. Of course, if the door (116) is installed as part of a door system (100) installed in a SRO orientation, the closing edge of the door (116) would be the left side of the door and the opening edge of the door (116) would be the right side of the door.

Figure 25:
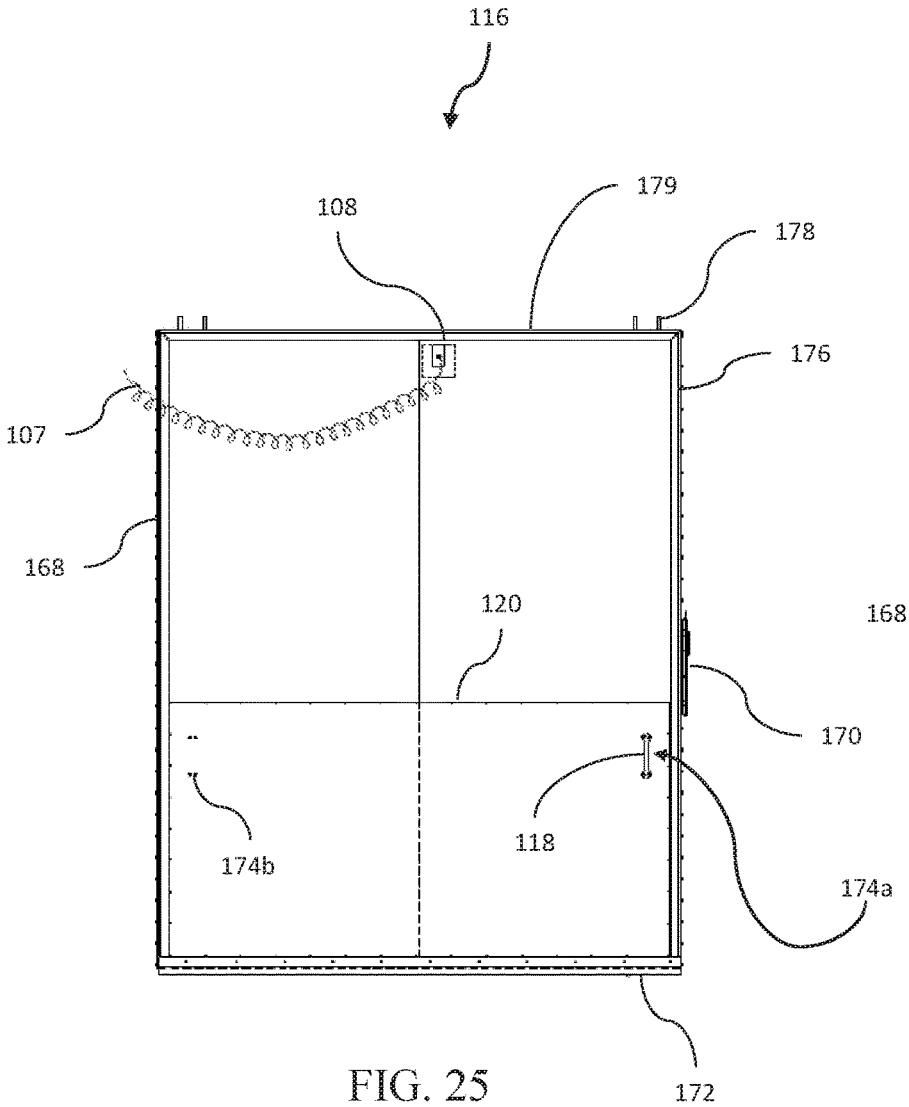
FIG. 25 depicts a front elevation view of an exemplary door for use with the universal sliding door system of FIG. 1 configured to be installed in a SLO orientation.
Figure 26:
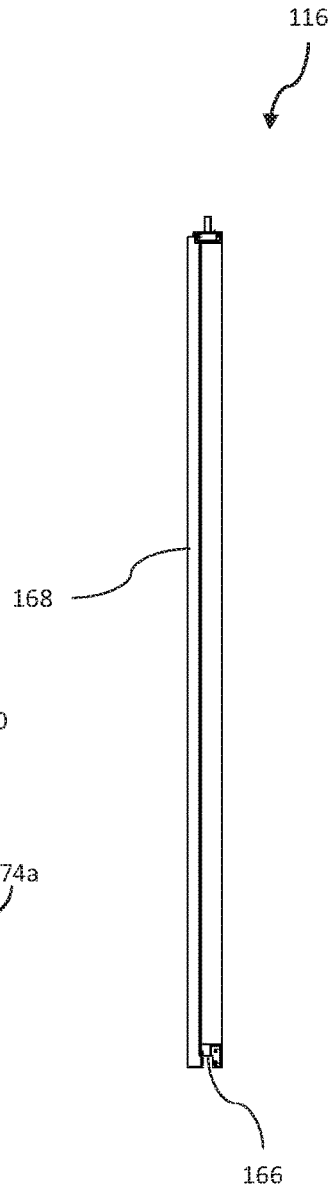
FIG. 26 depicts a right side elevation view of the door of FIG. 25.

FIG. 25 depicts the front side of the door (116). As shown, a panel-mounted electrical box (108) is mounted at about the midpoint of the width of the door (116) to allow for installation as SLO or SRO without requiring that the panel-mounted electrical box (108) be moved depending on the desired opening orientation. A coiled electrical cable (107) allows for an extended length when the door (116) is in the closed position, while the cable coils to prevent drooping or dragging when the door (116) is in the open position. A handle (118) may be installed on the front side of the door (116). In the illustrated embodiment, the handle (118) is installed adjacent to the closing edge of the door (116). The front side of the door (116) may include a first plurality of handle mounting openings (174*a*) configured to allow handle (118) to be installed adjacent to a first vertical edge of the door (116) and a second plurality of handle mounting openings (174*b*) configured to allow the handle (118) to be installed adjacent to the second vertical edge of the door (116). Such a configuration may allow the handle (118) to be easily installed adjacent to the closing edge of the door (116), which will vary based on the desired direction of opening. The openings in the first and second pluralities of handle mounting openings (174*a*, 174*b*) may comprise predrilled holes or location indicators (e.g., markings, dimples, etc.), or combinations thereof, to indicate where the connectors should be inserted to attach the handle (118) to the front side of the door (116). Use of location indicators may facilitate creation of the desired holes in the front side of the door (116) on-site as opposed to the holes being predrilled at the factory.

Figure 30:
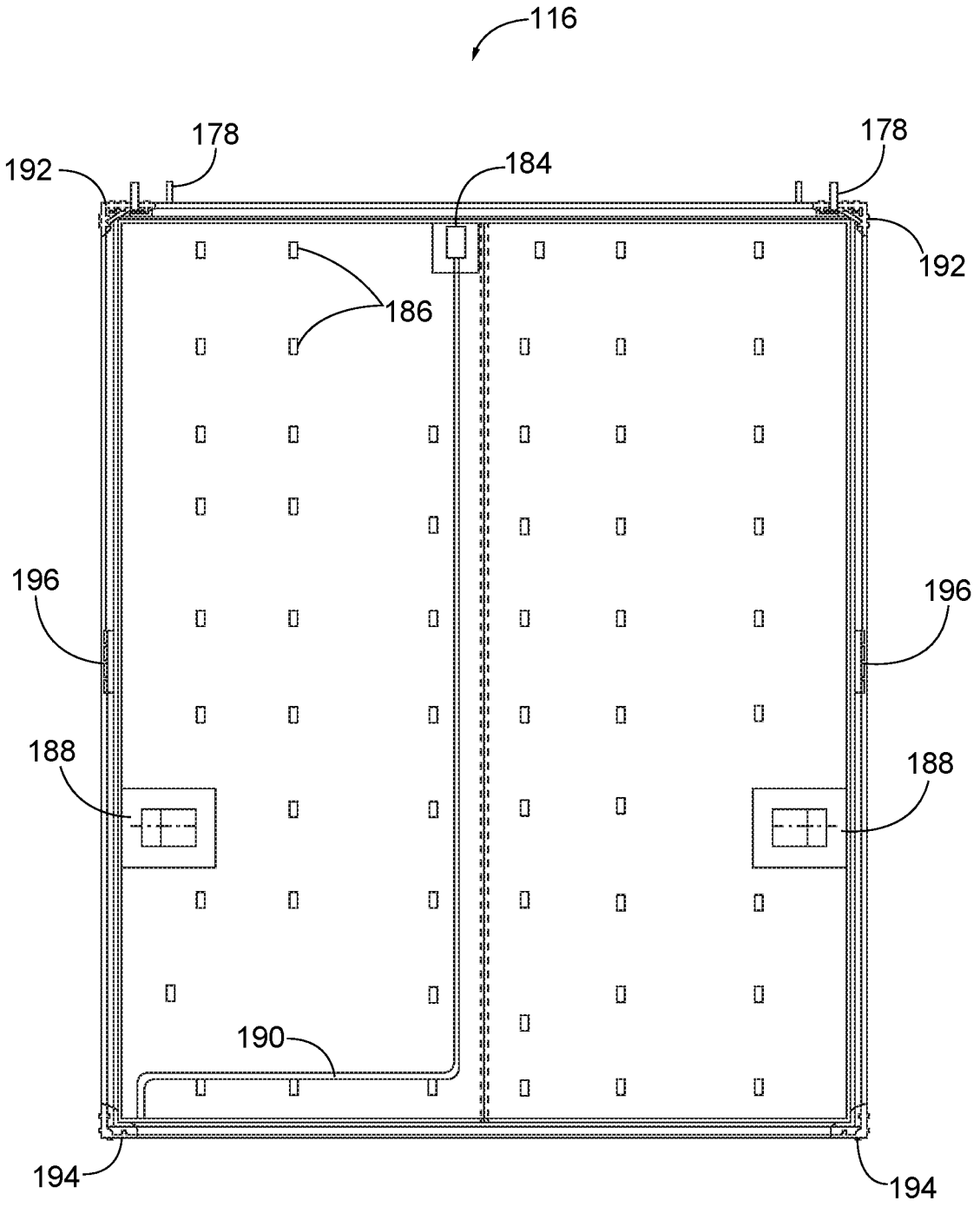
FIG. 30 depicts a rear elevation view of the door of FIG. 25 with the rear cover of the door removed.

In the illustrated embodiment, the door (116) also includes a breaker bar (170) installed on the closing edge of the door (116). The breaker bar (170) is configured to help a user break the seal around the door (116) when it is in the closed position to make it easier to slide the door (116) to the open position. As shown in FIG. 30, both vertical edges of the door (116) may be prepared to receive the breaker bar (170). Specifically, breaker bar blocking (196) may be installed on both vertical edges of the door (116), thereby allowing the breaker bar (170) to be installed on whichever edge will serve as the closing edge of the door (116) depending on the desired opening orientation. In some embodiments, the breaker bar (170) may be omitted. As shown, the door (116) also includes a sweep (172) attached to the bottom edge of the door (116) and a pair of roller hangers (178) located on the top edge of the door (116) that allow the roller assemblies that contain rollers (101) to be attached to the door (116).

As discussed above, an opening edge gasket (111) may be attached to the opening edge (168) of the door (116). The opening edge gasket (111) may be configured to create a seal along that edge of the door by contacting the sealing surface (169) of a seal block (160) installed on the opening edge vertical casing member (115). Because either vertical edge of the door (116) may serve as the opening edge depending on the desired opening orientation, both vertical edges of the door (116) may be prepared to easily receive an opening edge gasket (111). For example, both vertical edges of the door (116) may include a plurality of opening edge gasket mounting openings configured to allow an installer to easily install the opening edge gasket (111) on the appropriate vertical edge of the door (116) once the opening orientation is determined. In some embodiments, both vertical edges of the door (116) may also include aluminum peep strips in order to allow an installer to easily install the opening edge gasket (111) on the appropriate vertical edge of the door (116) once the opening orientation is determined. The openings in the first and second pluralities of opening edge gasket mounting openings may comprise predrilled holes or location indicators (e.g., markings, dimples, etc.), or combinations thereof, to indicate where the connectors should be inserted to attach the opening edge gasket (111) to the door (116). Use of location indicators may facilitate creation of the desired holes in the desired vertical edge of the door (116) on-site as opposed to the holes being predrilled at the factory.

Figure 27:
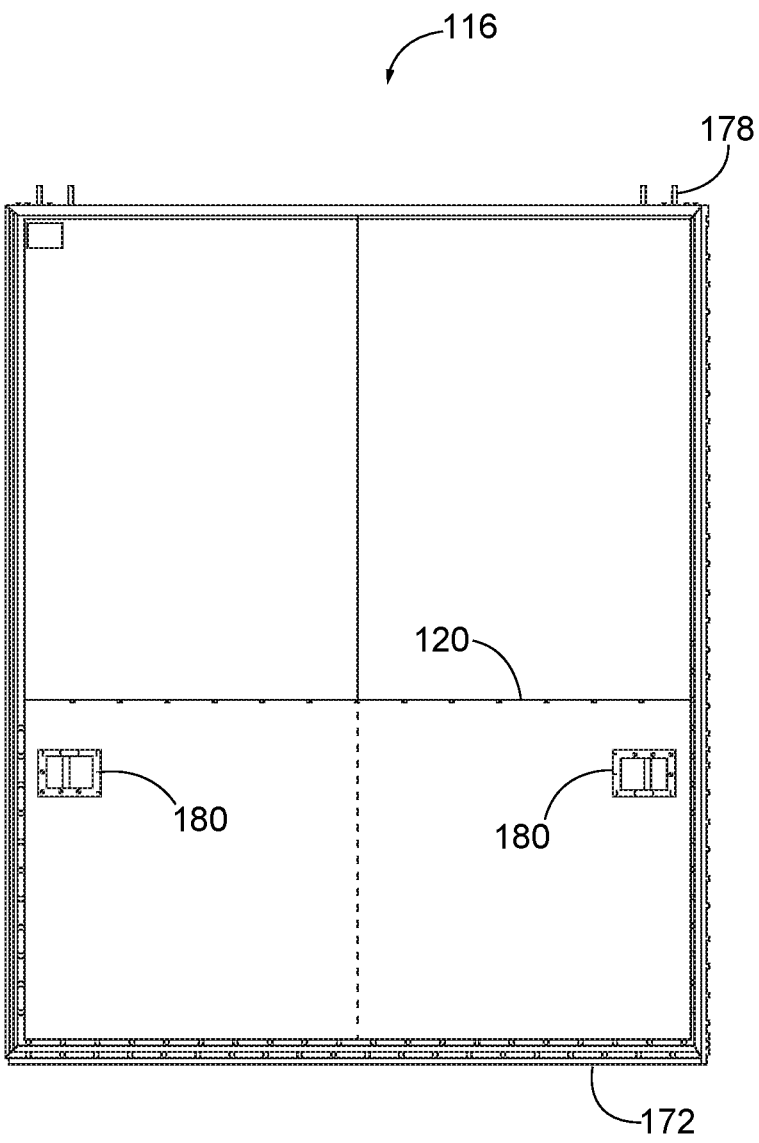
FIG. 27 depicts a rear elevation view of the door of FIG. 25.
Figure 28:
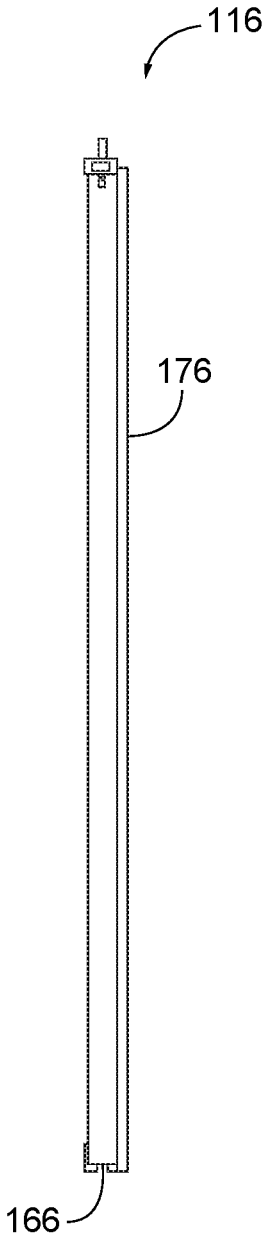
FIG. 28 depicts a left side elevation view of the door of FIG. 25.

FIG. 27 depicts the rear side of the door (116). In the illustrated embodiment, two interior pull handles (180) are recessed into the door (116) to facilitate opening and closing of the door (116). Installation of an interior pull handle (180) adjacent to each vertical edge of the door (116) allows the door (116) to be installed as part of a door system (100) in either a SRO or SLO orientation without needing to move existing pull handles or install additional pull handles. As depicted in FIG. 30, blocking (188) to support each of the interior pull handles (180) may be installed adjacent to each vertical edge of the door (116) in the interior shell of the door (116).

Figure 29:
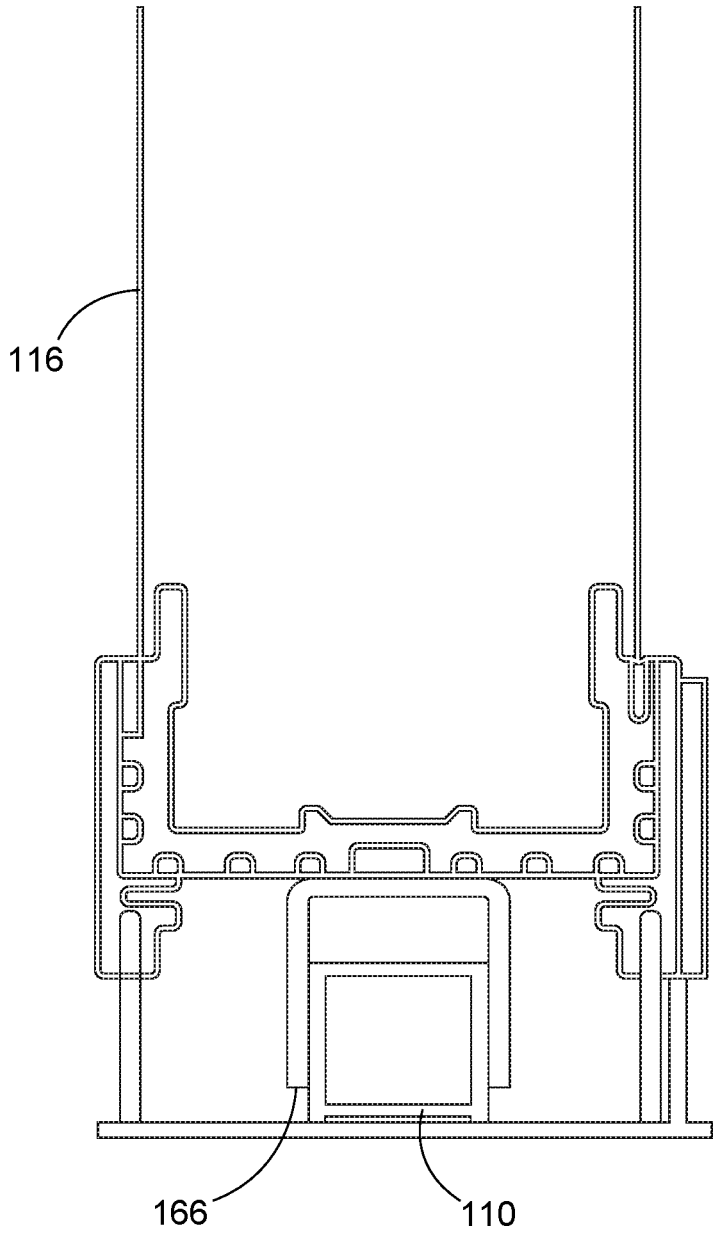
FIG. 29 depicts a partial side cross-sectional view of a bottom portion of the door of FIG. 25 engaged with a floor guide.

As shown in FIG. 29, the door (116) also includes an under panel guide channel (166) configured to correspond with and engage the floor guide (110) discussed above. The under panel guide channel (166) may be configured to engage the floor guide (110) in order to provide horizontal stability as the door (116) hangs from the track (112), to prevent side to side swinging or swaying and to keep the door (116) in the desired horizontally-oriented slide plane.

In some embodiments, the door (116) may comprise a shell with a rear cover and a front cover installed on either face. The internal space between the rear cover and the front cover may be injected with expanding foam or another similar material to provide insulation. Such a construction may reduce the overall weight of the door (116) and may provide an insulating air space within the door (116). FIG. 30 depicts the interior shell of one such embodiment of a door (116) with the rear cover removed. Top corner brackets (192) may be configured to provide additional stability for the upper corners of the door (116) and may also be integrated with roller hangers (178). Bottom corner brackets (194) may be configured to provide additional stability for the lower corners of the door (116). As discussed above, blocking for recessed pull handles (188) may be installed adjacent to both edges of the door (116) to provide a reinforced section for the pull handles (180) to be installed against. Also, as discussed above, breaker bar blocking (196) may be installed on each vertical edge of the door (116) to allow for a reinforced area of the door (116) for the beaker handle (170) to be installed upon. The breaker bar blocking (196) may comprise any suitable material configured to provide sufficient reinforcement, including but not limited to plastic, such as high-density polyethylene (HDPE). In addition, electrical box blocking (184) may be installed to provide a reinforced area for the panel mounted electrical box (108) to be installed upon.

In the illustrated embodiment, a plurality of spacers (186) are installed throughout the shell of the door to help support the front cover of the door (116) until the internal space of the door (116) is injected with expanding foam. The insulation provided by the expanding foam between the front cover and the rear cover may be particularly beneficial if the door (116) is a freezer door.

In this embodiment, an electrical conduit (190) is positioned within the shell of the door (116) and runs from the location of the electrical box (108) to the bottom of the door, though the particular positioning of the conduit (190) may vary in different embodiments. For example, a door close sensor or another electrical accessory may be installed at a particular location on the door (116) and that sensor may need to receive electrical power from the panel-mounted electrical box (108). The electrical conduit (190) could be positioned to allow wiring to safely run from the panel-mounted electrical box (108) to the electrical accessory.

Figure 31:
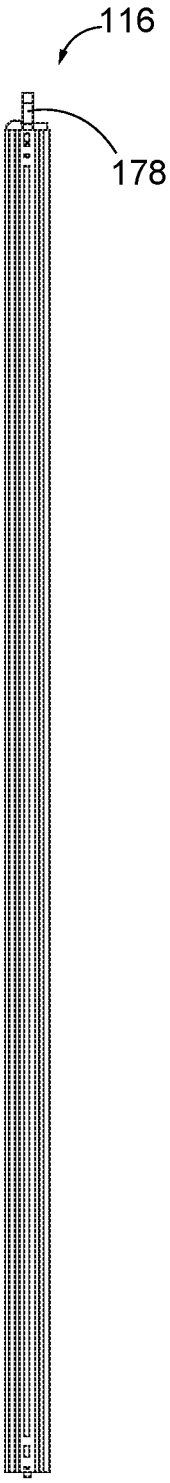
FIG. 31 depicts a left side elevation view of the door of FIG. 30 with the edge cap removed.
Figure 32:
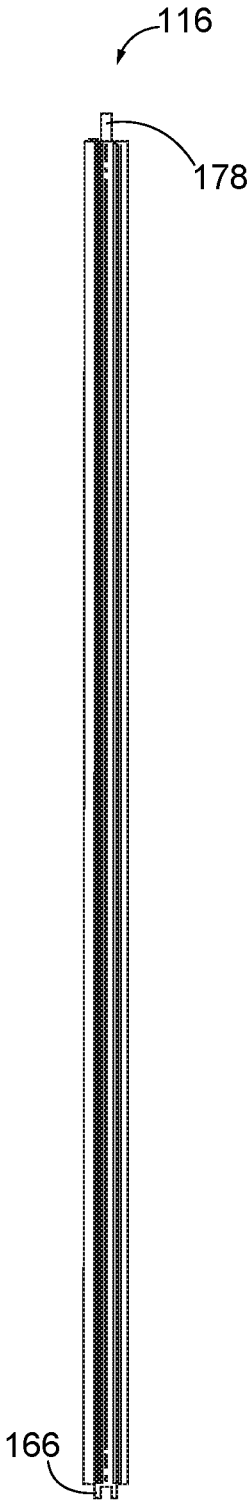
FIG. 32 depicts a right side elevation view of the door of FIG. 30 with the edge cap removed.

In some embodiments, the door (116) may comprise an edge cap configured to provide a finished appearance to the edge of the door (116). FIGS. 31 and 32 depict side views of the door (116) shown in FIG. 30 with the edge cap removed to reveal an edge protrusion. The edge protrusion may be included in embodiments where the door (116) is configured to be a freezer door.

Figure 33:
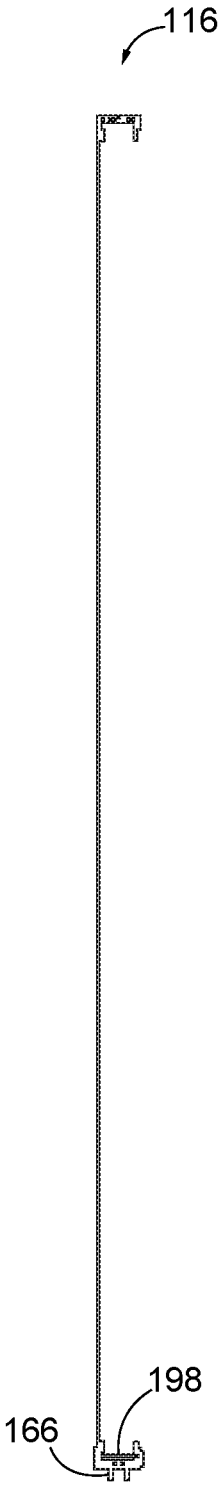
FIG. 33 depicts a side elevation cross-sectional view of the door of FIG. 30 with the rear cover removed.

In the embodiment shown in FIG. 33, the door (116) also includes blocking (198) along the bottom edge of the door (116). The blocking (198) may be configured to provide a reinforced area where the under panel guide channel (166) is installed.

Figure 34:
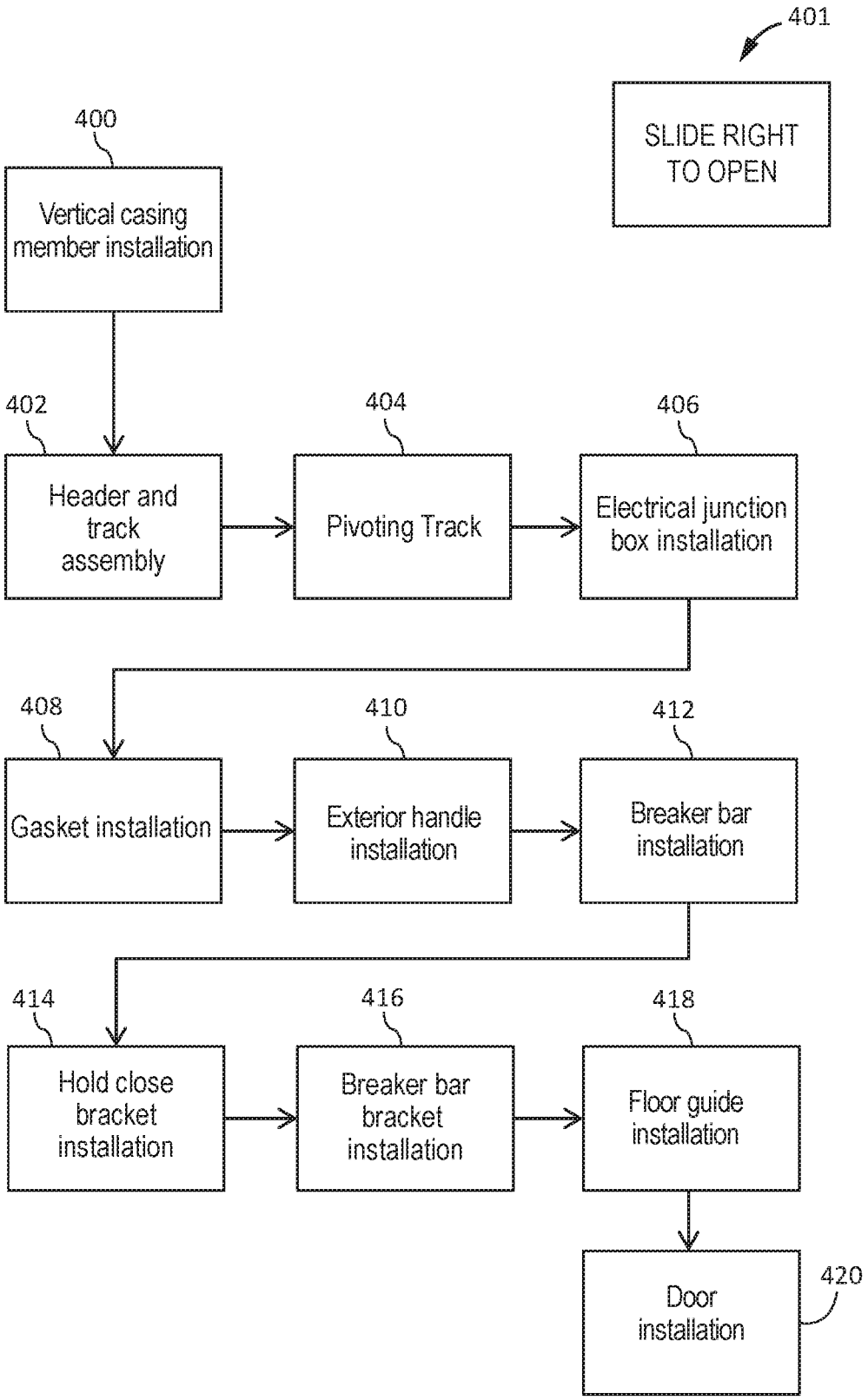
FIG. 34 is a flowchart depicting an exemplary embodiment of a method of installing a universal door system in a SRO orientation.

FIG. 34 is a flowchart depicting an exemplary method (401) of installing a universal sliding door system in a SRO orientation. It should be appreciated that the method (401) depicted in FIG. 34 and described herein is not an exhaustive list of all the steps that may be taken to install such a door system, some of the steps may be omitted in some embodiments, and the particular order of the steps may be varied. Furthermore, some of the steps illustrated in FIG. 34 may be performed either at the factory or on-site.

As shown in FIG. 34, the first step is a vertical casing member installation step (400). In this step, the vertical casing members (114, 115) may be flipped to the proper orientation so that the side surface (163) of the attached seal block (160) faces the doorway (129). The closing edge vertical casing member (114) is installed on the left edge of the doorway (129) and the opening edge vertical casing member (115) is installed on the right edge of the doorway (129). As part of step (414), one or more locator pins (158) may be installed in the corresponding openings in the upper edge of each of the vertical casing members (114, 115) to facilitate connection of the vertical casing embers (114, 115) with the header (113).

The next step in the illustrated method (401) is a header and track assembly step (402), wherein the header (113) and track (112) may be assembled for inclusion in a door system (100) installed in a SRO orientation by attaching the header (113) and track (112) to a support structure, such as a wall, above a doorway (129) and removing all connectors attaching the track (112) to the header (113) except for the pivot connector (122). The locator pins (158) installed in the vertical casing members (114, 115) may be used to help align and engage the header (113) with the vertical casing members (114, 115).

As shown, in the next pivoting track step (404), the track (112) is pivoted about the pivot connector (122) relative to the header (113) so that the right end is higher than the left end of the track (112), causing the track (112) to slant from the right end or opening end of the track (112) downward toward the left end or closing end of the track (112). The track (112) may be pivoted any suitable amount, including but not limited to an amount resulting in the right end of the track (112) being about 0.5 inches higher than the left end of the track (112).

In the next step of the illustrated method (401), which is an electrical junction box installation step (406), an electrical junction box (102) may be installed at the right end or opening end of header (113).

As shown in FIG. 34, the next step of the method (401) is a gasket installation step (408), wherein an opening edge gasket (111) is installed on the right edge, or opening edge, of the door (116) so that it seals against the seal block (160) attached to the opening edge vertical casing member (115) as the door (116) slides into the closed position. Also as part of gasket installation step (408), a closing edge gasket (109) may be installed on the seal block (160) of the closing edge vertical casing (114) member so that it seals against the left edge, or closing edge, of the door (116) when the door (116) is in the closed position.

In the next step of the illustrated method, which is an exterior handle installation step (410), an exterior handle (118) may be installed adjacent to the left edge, or closing edge, of the door (116). As depicted in FIG. 34, the next step in method (401) is a breaker bar installation step (412), wherein a breaker bar (170) is installed on the left edge, or closing edge, of the door (116) to assist a user in opening the door to the right with the aid of the breaker bar (170) and exterior handle (118). As shown, the next step is a hold close bracket installation step (414), wherein a hold close bracket (136) is installed adjacent to the left end, or closing end, of the track (112) to provide additional resistance to help keep the door (116) in a static position when the door (116) is in the closed position.

Continuing with the illustrated method (401), the next step is a breaker bar bracket installation step (416), a breaker bar bracket (156) may be installed in the upper position on the closing edge vertical casing member (114) (i.e., on the upper one of the first reinforcing plate (154*a*) and second reinforcing plate (154*b*)) so that the breaker bar (170) pushes against the bracket (156) when in use. The next step of the method shown in FIG. 34 is a floor guide installation step (418), wherein a floor guide (110) is attached to the floor with the mounting portion of the floor guide (110) extending to the right, so that the door (116) remains engaged with the floor guide (110) as the door (116) travels left-to-right from the closed position to the open position. The final step of the method shown in FIG. 34 is a door installation step (420). In this step, the door (116) is suspended from track (112) by positioning rollers (108) on track (112).

Figure 35:
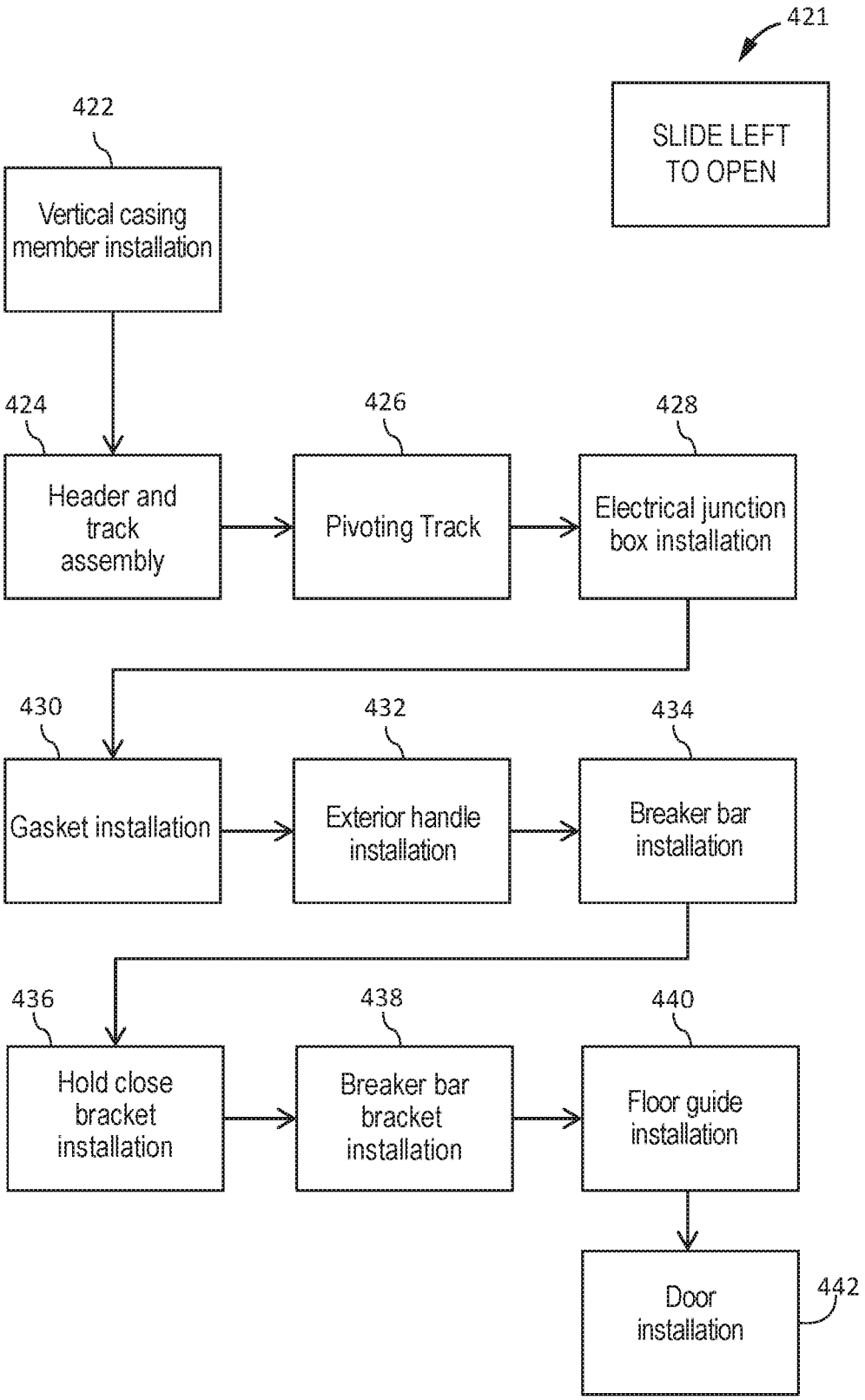
FIG. 35 is a flowchart depicting an exemplary embodiment of a method of installing a universal door system in a SLO orientation.

FIG. 35 is a flowchart depicting an exemplary method (421) of installing a universal sliding door system in a SLO orientation. It should be appreciated that the method (421) depicted in FIG. 35 and described herein is not an exhaustive list of all the steps that may be taken to install such a door system, some of the steps may be omitted in some embodiments, and the particular order of the steps may be varied. Furthermore, some of the steps illustrated in FIG. 35 may be performed either at the factory or on-site. The method (421) for a SLO installation depicted in FIG. 35 and described below is substantially similar to the method (401) for a SRO installation depicted in FIG. 34 and described above, except the orientation and/or location for some of the components has been reversed.

As shown in FIG. 35, the first step is a is a vertical casing member installation step (422). In this step, the vertical casing members (114, 115) may be flipped to the proper orientation so that the side surface (163) of the attached seal block (160) faces the doorway (129). The closing edge vertical casing member (114) is installed on the right edge of the doorway (129) and the opening edge vertical casing member (115) is installed on the left edge of the doorway (129). As part of step (436), one or more locator pins (158) may be installed in the corresponding openings in the upper edge of each of the vertical casing members (114, 115) to facilitate connection of the vertical casing embers (114, 115) with the header (113).

The next step in the illustrated method (421) is a header and track assembly step (424), wherein the header (113) and track (112) may be assembled for inclusion in a door system (100) installed in a SLO orientation by attaching the header (113) and track (112) to a support structure, such as a wall, above a doorway (129) and removing all connectors attaching the track (112) to the header (113) except for the pivot connector (122). The locator pins (158) installed in the vertical casing members (114, 115) may be used to help align and engage the header (113) with the vertical casing members (114, 115).

As shown, in the next pivoting track step (426), the track (112) is pivoted about the pivot connector (122) relative to the header (113) so that the left end is higher than the right end of the track (112), causing the track (112) to slant from the left end, or opening end, of the track (112) downward toward the right end, or closing end, of the track (112). The track (112) may be pivoted any suitable amount, including but not limited to an amount resulting in the left end of the track (112) being about 0.5 inches higher than the right end of the track (112).

In the next step of the illustrated method (421), which is an electrical junction box installation step (428), an electrical junction box (102) may be installed at the left end, or opening end, of header (113).

As shown in FIG. 35, the next step of the method (421) is a gasket installation step (430), wherein an opening edge gasket (111) is installed on the left edge, or opening edge, of the door (116) so that it seals against the seal block (160) attached to the opening edge vertical casing member (115) as the door (116) slides into the closed position. Also as part of gasket installation step (428), a closing edge gasket (109) may be installed on the seal block (160) of the closing edge vertical casing (114) member so that it seals against the right edge, or closing edge, of the door (116) when the door (116) is in the closed position.

In the next step of the illustrated method, which is an exterior handle installation step (432), an exterior handle (118) may be installed adjacent to the right edge, or closing edge, of the door (116). As depicted in FIG. 35, the next step in method (421) is a breaker bar installation step (434), wherein a breaker bar (170) is installed on the right edge, or closing edge, of the door (116) to assist a user in opening the door to the left with the aid of the breaker bar (170) and exterior handle (118). As shown, the next step is a hold close bracket installation step (436), wherein a hold close bracket (136) is installed adjacent to the right end, or closing end, of the track (112) to provide additional resistance to help keep the door (116) in a static position when the door (116) is in the closed position.

Continuing with the illustrated method (421), the next step is a breaker bar bracket installation step (438), a breaker bar bracket (156) may be installed in the upper position on the closing edge vertical casing member (114) (i.e., on the upper one of the first reinforcing plate (154*a*) and the second reinforcing plate (154*b*)) so that the breaker bar (170) pushes against the bracket (156) when in use. The next step of the method shown in FIG. 35 is a floor guide installation step (440), wherein a floor guide (110) is attached to the floor with the mounting portion of the floor guide (110) extending to the left, so that the door (116) remains engaged with the floor guide (110) as the door (116) travels right-to-left from the closed position to the open position. The final step of the method shown in FIG. 35 is a door installation step (442). In this step, the door (116) is suspended from track (112) by positioning rollers (108) on track (112).

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

What is claimed is:

1. A sliding door system comprising:

a. a header;

b. a track comprising a first end and a second end, wherein the track comprises a first plurality of track openings configured to be used to fix the track relative to the header in a first track position and a second plurality of track openings configured to be used to fix the track relative to the header in a second track position, wherein the first plurality of track openings comprises a first opening closest to the first end of the track and a second opening closest to the second end of the track, wherein the first plurality of track openings are arranged such that the first opening of the first plurality of track openings is lower than the second opening of the first plurality of track openings, wherein the second plurality of track openings comprises a third opening closest to the first end of the track and a fourth opening closest to the second end of the track, wherein the second plurality of track openings are arranged such that the third opening of the second plurality of track openings is higher than the fourth opening of the second plurality of track openings, wherein when the track is in the first track position the track is angled such that the first end of the track is lower than the second end of the track, wherein when the track is in the second track position the track is angled such that the first end of the track is higher than the second end of the track; and c. a door, wherein the door is slidably suspended from the track.

2. The sliding door system of claim 1, wherein the track is attached to the header at a pivot connection such that before the track is fixed in one of the first track position and the second track position, the track is pivotable relative to the header about the pivot connection between the first track position and the second track position.

3. The sliding door system of claim 1, wherein the first plurality of track openings comprises predrilled holes.

4. The sliding door system of claim 1, wherein the second plurality of track openings comprises predrilled holes.

5. The sliding door system of claim 1, wherein the first plurality of track openings comprises location indicators.

6. The sliding door system of claim 1, wherein the second plurality of track openings comprises location indicators.

7. The sliding door system of claim 1, wherein the header comprises a length and a top gasket system that extends along substantially the entire length of the header.

8. The sliding door system of claim 1, wherein the header comprises a first plurality of header openings configured to be used in conjunction with the first plurality of track openings to fix the track relative to the header in the first track position and a second plurality of header openings configured to be used in conjunction with the second plurality of track openings to fix the track relative to the header in the second track position, wherein at least one of the first plurality of header openings is aligned with a corresponding one of the first plurality of track openings and at least one of the second plurality of header openings is aligned with a corresponding one of the second plurality of track openings.

9. The sliding door system of claim 8, wherein the first plurality of header openings comprises predrilled holes.

10. The sliding door system of claim 8, wherein the second plurality of header openings comprises predrilled holes.

11. The sliding door system of claim 8, wherein the first plurality of header openings comprises location indicators.

12. The sliding door system of claim 8, wherein the second plurality of header openings comprises location indicators.

13. The sliding door system of claim 1 further comprising an electrical box mounted on the door, wherein the electrical box is mounted at about a midpoint of a width of the door.

14. The sliding door system of claim 13, wherein the header comprises a first set of electrical junction box mounting openings located adjacent to a first end of the header and a second set of electrical junction box mounting openings located adjacent to a second end of the header, wherein both the first set of electrical junction box mounting openings and the second set of electrical junction box mounting openings are configured to receive connectors to secure an electrical junction box to the header.

* * * * *